US009042788B2

(12) United States Patent
Nishino

(10) Patent No.: US 9,042,788 B2
(45) Date of Patent: May 26, 2015

(54) CHARGING DEVICE

(71) Applicant: CANON KABUSHIKI KAISHA, Tokyo (JP)

(72) Inventor: Yoshiro Nishino, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/080,226

(22) Filed: Nov. 14, 2013

(65) Prior Publication Data

US 2014/0133887 A1 May 15, 2014

(30) Foreign Application Priority Data

Nov. 15, 2012 (JP) ..... 2012-251574

(51) Int. Cl.
*G03G 15/02* (2006.01)

(52) U.S. Cl.
CPC ..... *G03G 15/0291* (2013.01)

(58) Field of Classification Search
CPC ..... G03G 15/0291; G03G 2215/027; G03G 2221/1693
USPC ..... 399/115, 170, 171, 172; 361/225; 250/324, 325, 326
See application file for complete search history.

(56) References Cited

U.S. PATENT DOCUMENTS

2010/0158550 A1 6/2010 Makino et al.
2011/0222898 A1* 9/2011 Kidaka ..... 399/170 X
2011/0222901 A1* 9/2011 Makino ..... 399/171 X

FOREIGN PATENT DOCUMENTS

JP 2010-145840 A 7/2010

* cited by examiner

*Primary Examiner* — Sophia S Chen
(74) *Attorney, Agent, or Firm* — Fitzpatrick, Cella, Harper & Scinto

(57) ABSTRACT

A charging device for electrically charging a photosensitive member, includes: a discharging electrode; a casing provided with an opening; a grid provided at the opening; a sheet-shaped shutter; a moving portion; a connecting portion; a winding-up portion; an urging portion; a first supporting portion; a second supporting portion; and an operating portion. The winding-up portion is configured to wind up, when the shutter is closed, the shutter so that a surface of the shutter opposing the photosensitive member is an outermost surface. When movement of the shutter in the opening direction is completed, the operating portion is covered with the shutter. When the connecting portion is separated from the moving portion, a leading end portion of the shutter with respect to the closing direction is movable toward a downstream side of the operating portion with respect to the opening direction by a winding-up force by the urging portion.

8 Claims, 20 Drawing Sheets

(a)

(b)

(a)

(b)

(a)

(b)

CHARGING DEVICE

FIELD OF THE INVENTION AND RELATED ART

The present invention relates to a charging device (apparatus) for use with an image forming apparatus, of an electrophotographic type, such as a copying machine, a printer, a facsimile machine or a multi-function machine having a plurality of functions of these machines.

In the image forming apparatus of the electrophotographic type, an image is formed by an electrophotographic process including charging, exposure, development and transfer. Of these steps, in the charging step, an electrophotographic photosensitive member is electrically charged uniformly to a predetermined polarity and a predetermined potential by a corona charger provided closely to the photosensitive member. In a charging type using the corona charger, a surface of the photosensitive member is electrically charged by using corona discharge.

By this corona discharge, ozone is generated and reacts with nitrogen in the air to form a nitrogen oxide. Then, the nitrogen oxide reacts with water content to form nitric acid. There is a fear that the thus-generated corona discharge product such as nitrogen oxide or nitric acid is deposited on the photosensitive member to contaminate the surface of the photosensitive member.

Further, the corona discharge product has a characteristic such that the corona discharge product is liable to take up moisture, and the corona discharge product deposited on the surface of the photosensitive member takes up moisture, so that an electric resistance value is lowered. By the lowering in electric resistance at the photosensitive member surface, charge retaining power at a part or whole of the member surface is lowered. Thus, by the lowering in charge retaining power, a normal electrostatic image (electrostatic latent image) cannot be formed at a normal potential, so that image defect is generated in some cases. Particularly, when a main assembly of the image forming apparatus is started up by turning on a power source from an OFF state, a temperature rise of the photosensitive member is slower than temperature rise of a peripheral portion, and therefore condensation is a tendency to increase a possibility of generation of the image defect.

In order to suppress the above-described image defect resulting from the corona discharge product, Japanese Laid-Open Patent Application (JP-A) 2010-145840 proposes a method such that when an apparatus main assembly is in an OFF state of a power source, an opening of a corona charger opposing a photosensitive member is shielded with a shutter. This is a method in which the corona discharge product which is liable to take up moisture is prevented from being dropped and deposited on the photosensitive member surface by shielding the opening of the corona charger during the OFF state of the power source of the apparatus main assembly. In this case, during an ON state of the power source of the apparatus main assembly, control is made by opening a shutter so that the opening of the corona charger opposes the photosensitive member.

In order to electrically charge the photosensitive member efficiently, it is desired that a grid electrode is disposed closely to the photosensitive member in the neighborhood of the opening of the corona charger. For that reason, the shutter is disposed in a narrow space between the photosensitive member and the grid electrode. Accordingly, as the shutter, a sheet-shaped member is used, and when the shutter is accommodated, the shutter is wound up in a rotational axis direction of the photosensitive member by a winding-up mechanism provided adjacently to the corona charger.

Incidentally, in the above-described method in which the opening of the corona charger is covered with the sheet-shaped shutter, in a position adjacent to the corona charger, the winding-up mechanism for winding up the shutter is provided. Further, a connecting portion is provided at a leading end portion of the shutter in order to pull out the shutter and is connected with a moving mechanism as a moving portion for opening and closing the shutter.

However, the grid electrode is disposed at the opening of the corona charger, and therefore in some cases, the grid electrode is demounted and mounted during maintenance. Further, when the grid electrode is demounted and mounted, the shutter disposed closer to the photosensitive member than the grid electrode can constitute an obstacle to the demounting and mounting operation of the grid electrode.

For that reason, it would be considered that the shutter is prevented from constituting the obstacle to the demounting and mounting operation of the grid electrode by increasing a movement region, in which the shutter is moved to be opened and closed, to make the shutter movable to a position in which the grid electrode is not covered with the shutter. However, in this case, there is a need to increase the shutter movement region to a position where a grid electrode supporting mechanism is exposed, so that there is a problem such that the corona charger is upsized. Therefore, there is a need to demount the shutter from the moving means in advance of the grid electrode demounting and mounting operation. However, even in the case where the shutter is demounted from the moving mechanism, the connecting portion provided at the leading end portion of the demounted shutter is caught by a part of a cover, so that the demounted shutter still covers the grid electrode, and therefore there was a need to perform the operation in a state in which the demounted shutter was raised and held during the operation, thus resulting in a problem such that operativity (working property) was poor.

SUMMARY OF THE INVENTION

A principal object of the present invention is to provide a charging device having solved the above-described problem.

According to an aspect of the present invention, there is provided a charging device for electrically charging a photosensitive member, comprising: a discharging electrode provided along a longitudinal direction of the charging device; a casing which surrounds the discharging electrode and which is provided with an opening between the discharging electrode and the photosensitive member; a grid provided at the opening along the longitudinal direction of the charging device; a sheet-shaped shutter, provided closer to the photosensitive member than the grid, for opening and closing the opening; a moving portion for moving the shutter, along the longitudinal direction of the charging device, in an opening direction for opening the opening and a closing direction for closing the opening; a connecting portion, provided at a leading end portion of the shutter with respect to the closing direction, for being separably connected with the moving portion; a winding-up portion for winding-up the shutter with movement of the shutter in the opening direction; an urging portion for urging the shutter in a winding-up direction of the shutter; a first supporting portion for detachably mountably supporting an upstream end portion, with respect to the closing direction, of end portions of the grid with respect to a longitudinal direction of the grid; a second supporting portion for detachably mountably supporting a downstream end portion, with respect to the closing direction, of the end portions of the grid with respect to the longitudinal direction of the grid; and an operating portion, provided downstream of the first supporting portion with respect to the opening direction, operable so that the first supporting portion is moved to a position where the first supporting portion and the grid are detachably mountable, wherein the winding-up portion is configured to wind up, when the shutter is closed, the shutter so that a surface of the shutter opposing the photosensitive member is an outermost surface, wherein when movement of the shutter in the opening direction is completed, the operating portion is covered with the shutter, and wherein when the connecting portion is separated from the moving portion, the leading end portion of the shutter with respect to the closing direction is movable toward a downstream side of the operating portion with respect to the opening direction by a winding-up force by the urging portion.

These and other objects, features and advantages of the present invention will become more apparent upon a consideration of the following description of the preferred embodiments of the present invention taken in conjunction with the accompanying drawings.

Figure 3:
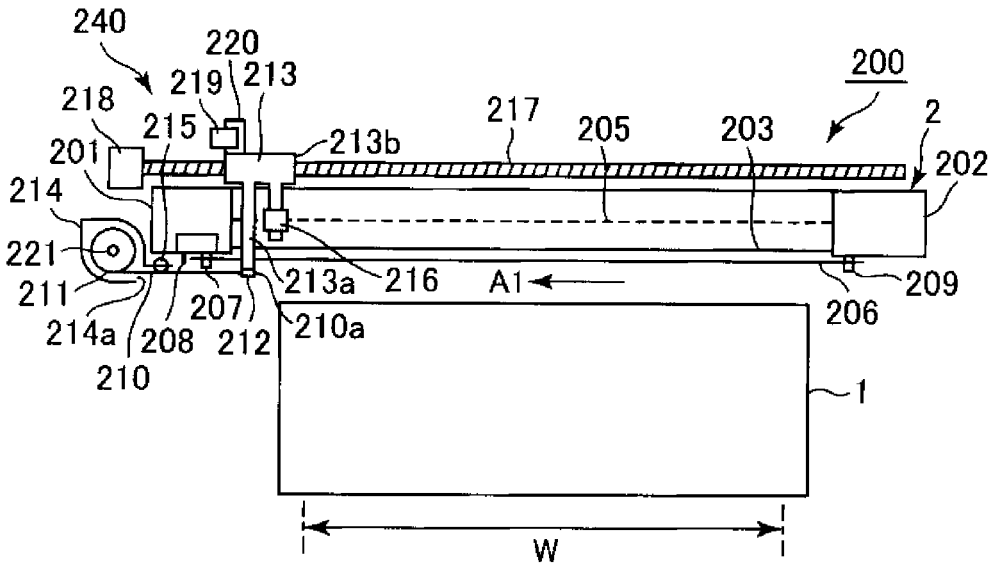
Figure 3:
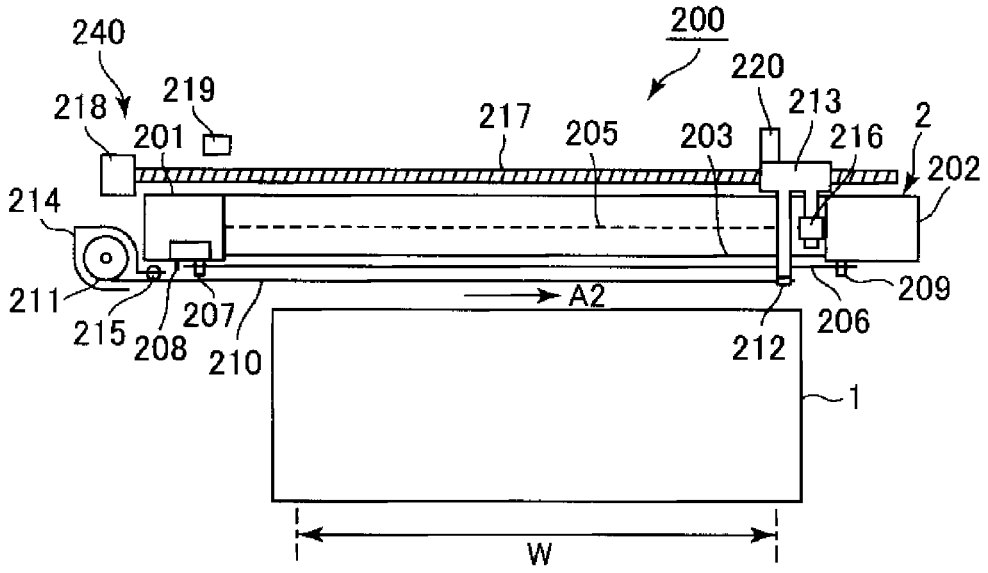

Parts (a) and (b) of FIG. 3 are schematic sectional views of the charging device with respect to a longitudinal direction in Embodiment 1.

Figure 4:
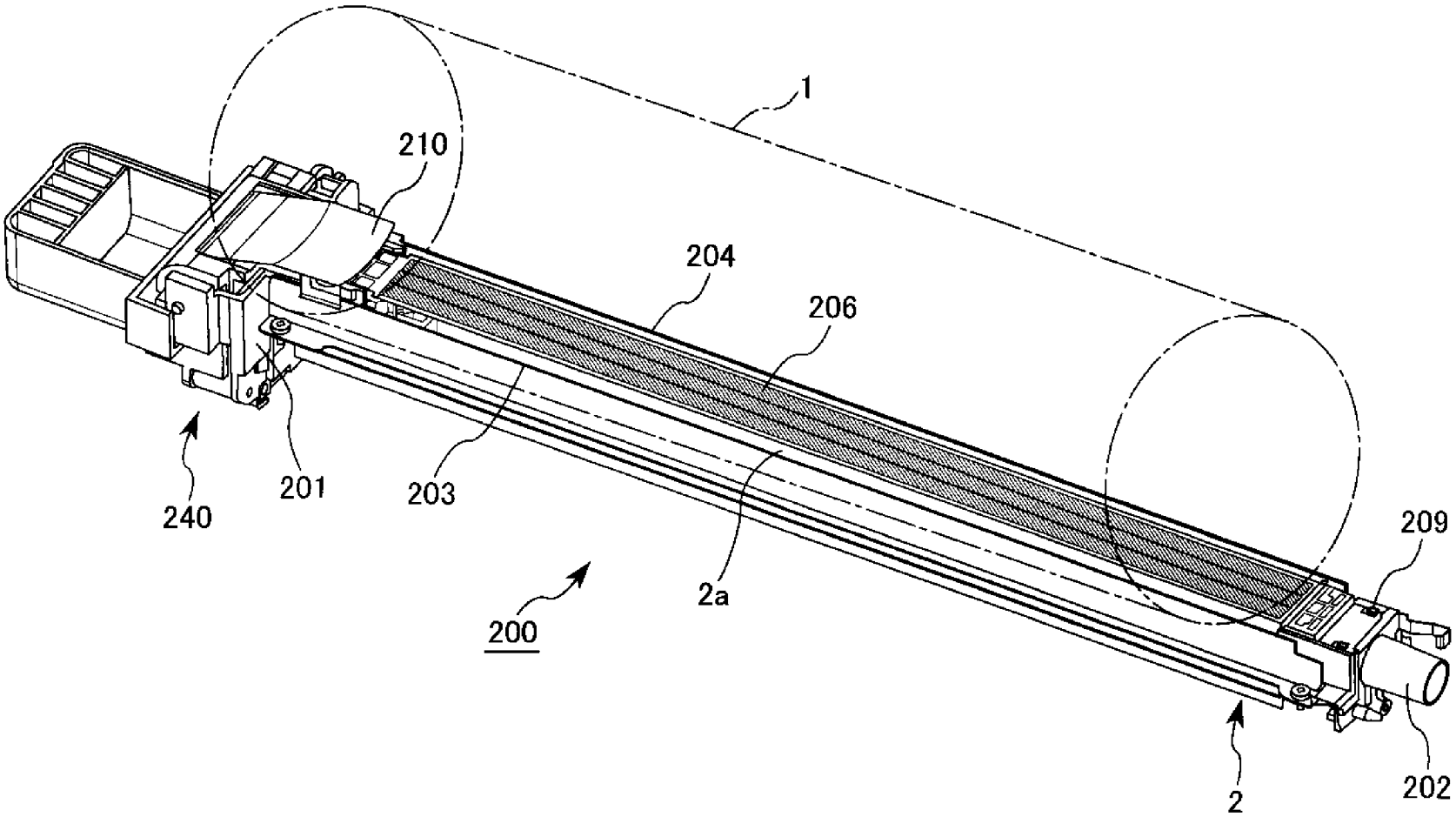

FIG. 4 is a perspective view of the charging device in Embodiment 1.

Figure 5:
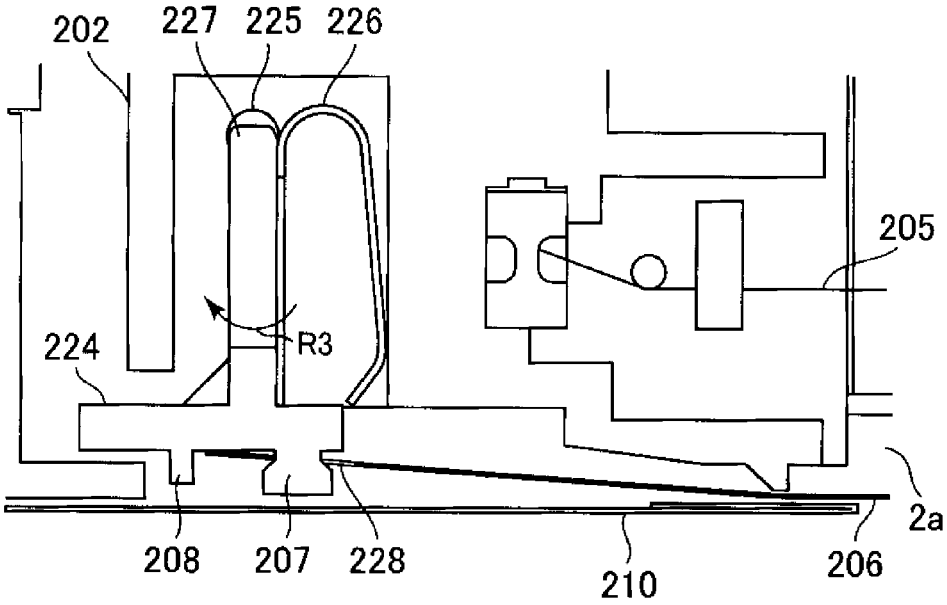
Figure 5:
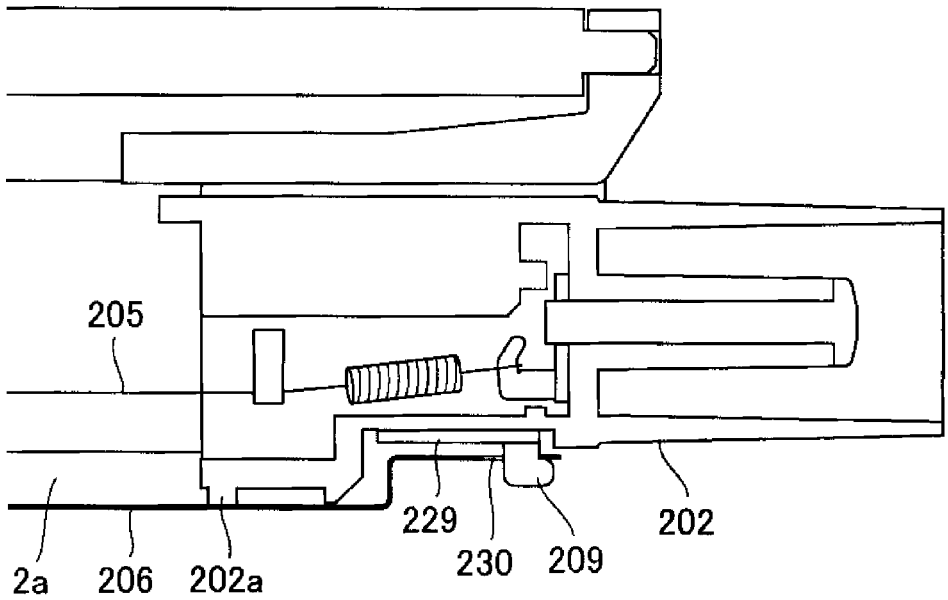

Parts (a) and (b) of FIG. 5 are enlarged sectional views each showing the neighborhood of a grid electrode supporting mechanism of the charging device in Embodiment 1.

Figure 6:
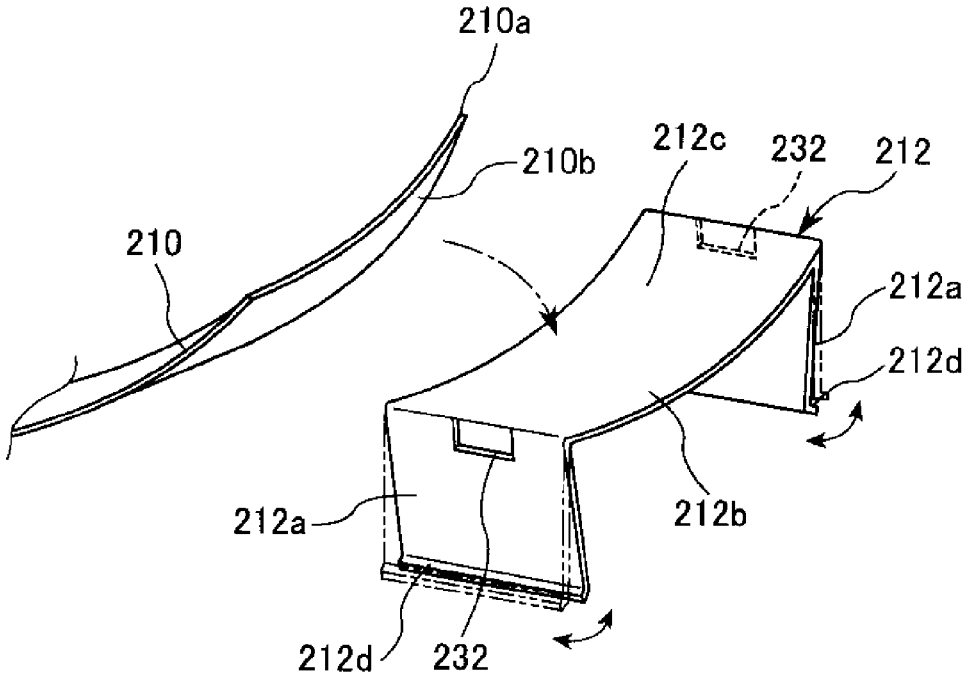

FIG. 6 is a perspective view of a connecting portion in the charging device in Embodiment 1.

Figure 7:
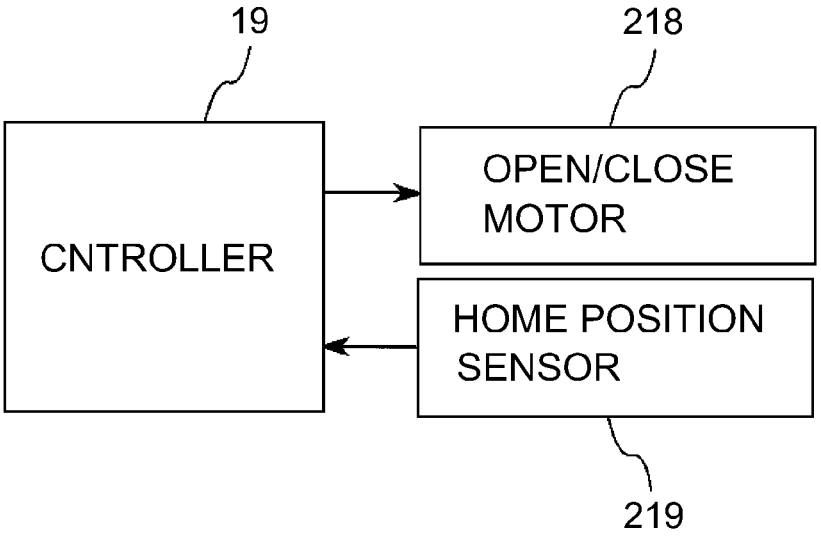

FIG. 7 is a schematic control block diagram of a shutter opening and closing operation in Embodiment 1.

Figure 8:
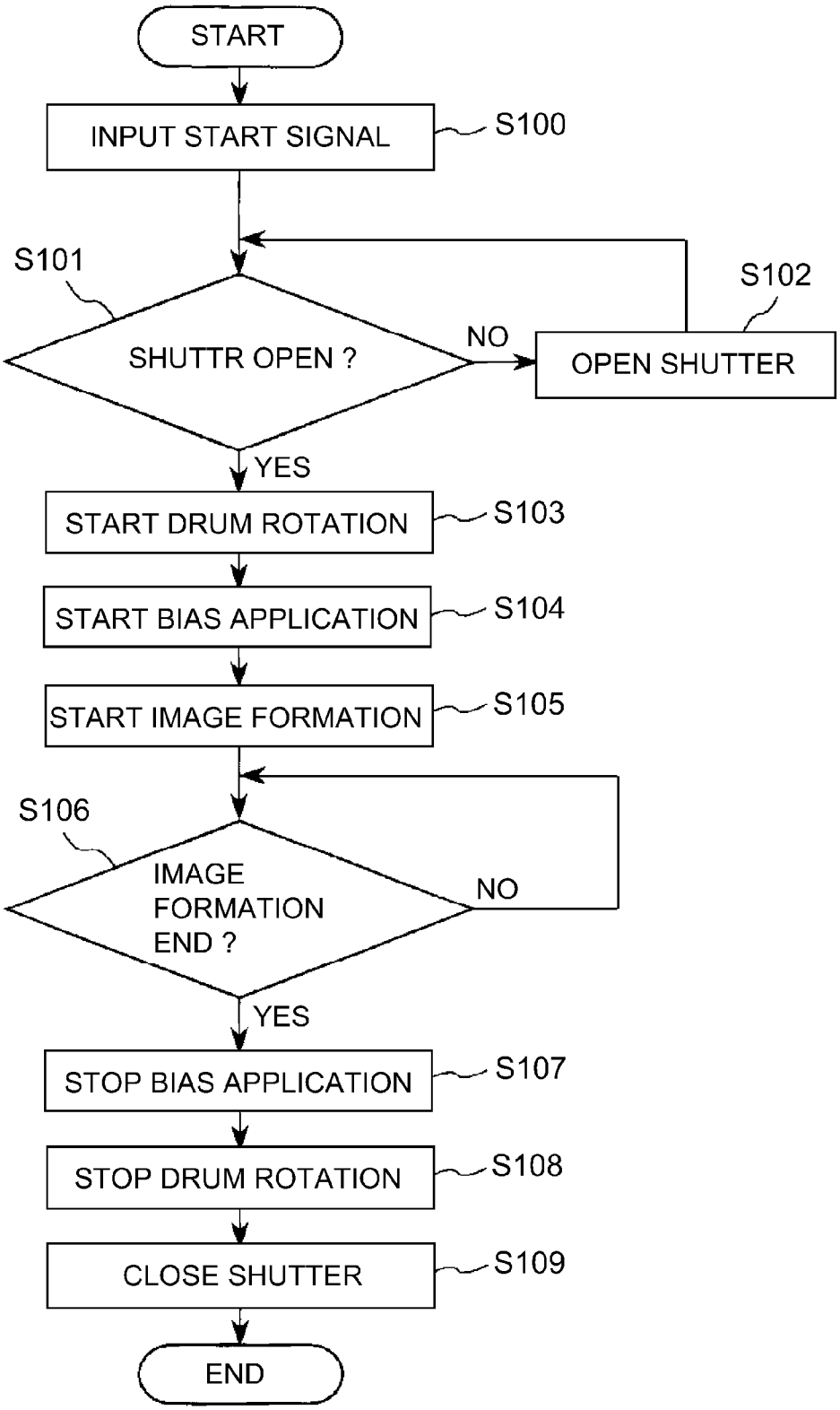

FIG. 8 is a flowchart of an example of a procedure of the shutter opening and closing operation in Embodiment 1.

Figure 9:
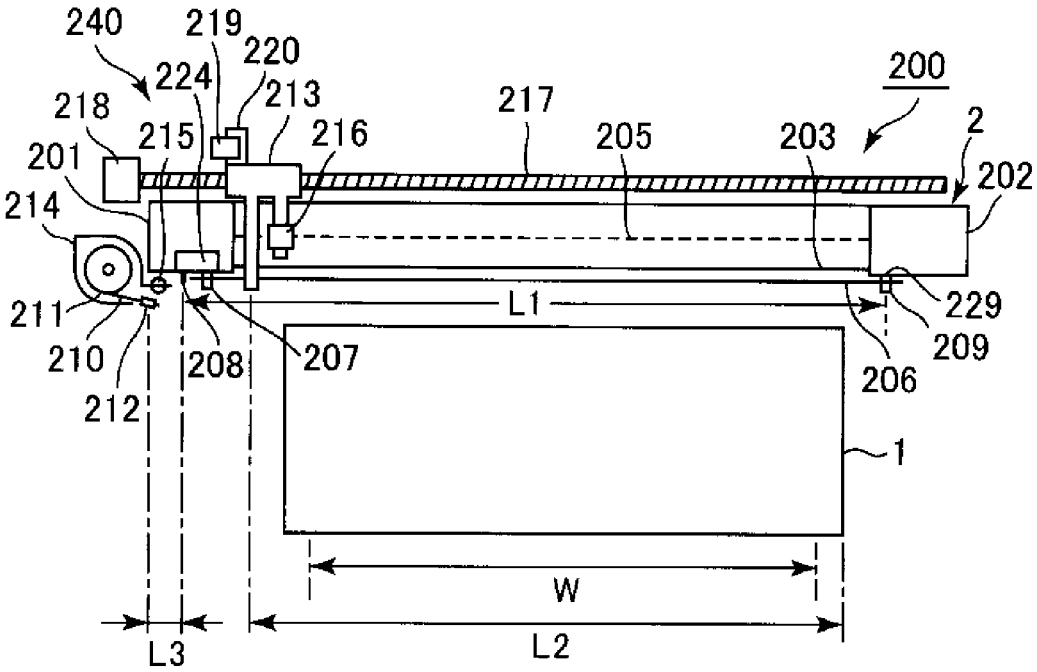

FIG. 9 is a schematic sectional view of the charging device with respect to the longitudinal direction in Embodiment 1.

Figure 10:
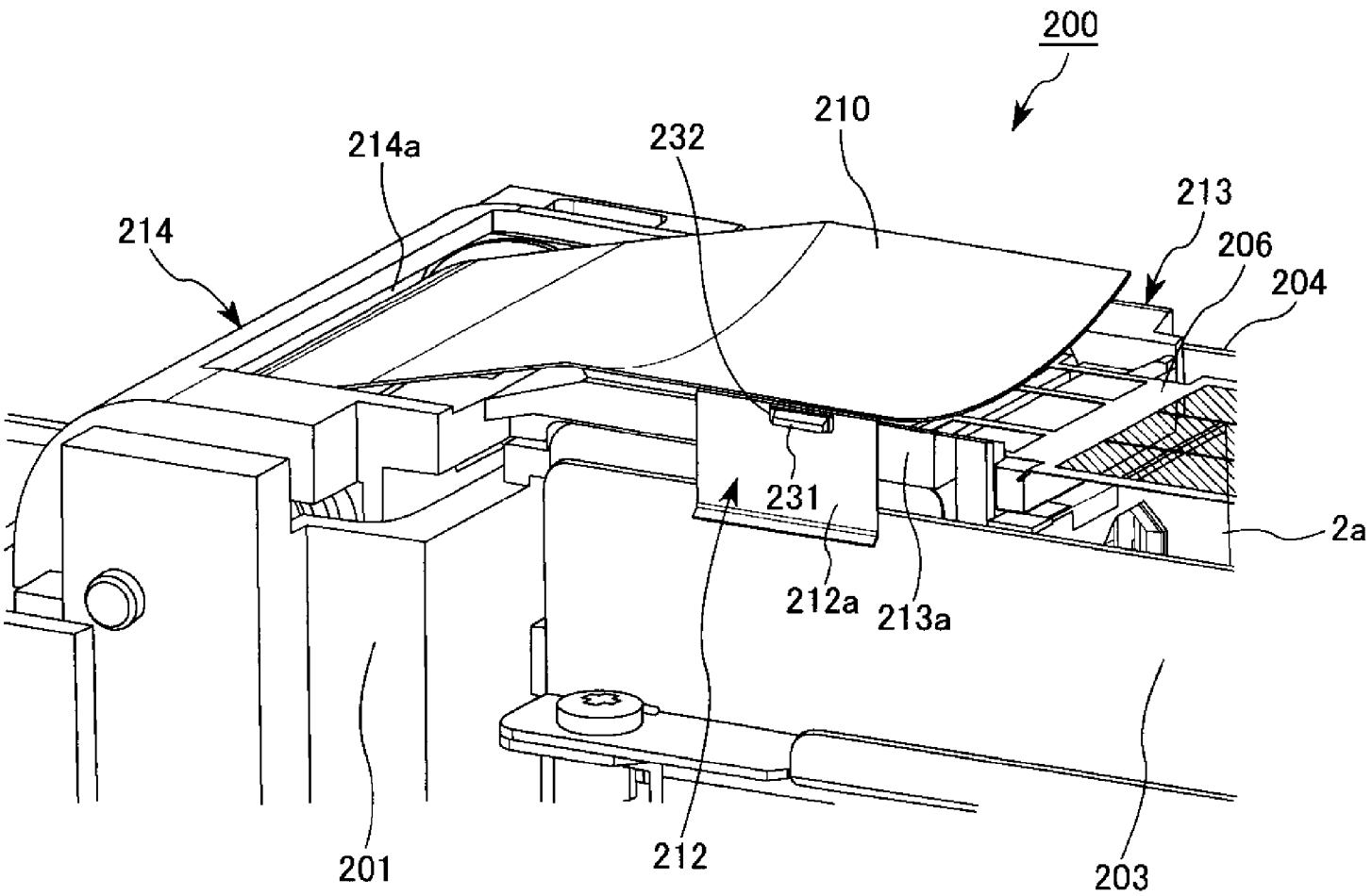
Figure 11:
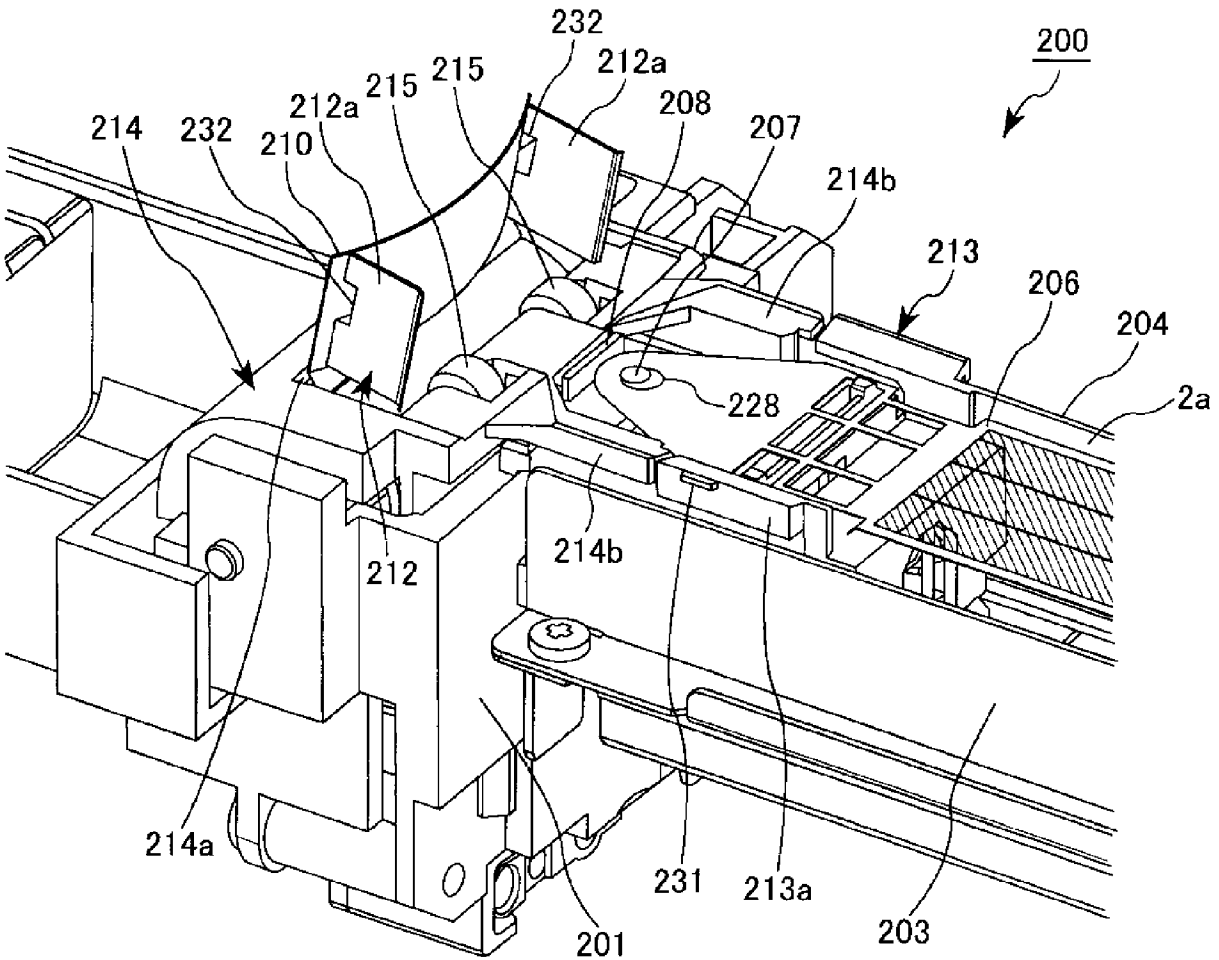

FIGS. 10 and 11 are enlarged perspective views each showing the neighborhood of a shutter opening position end position in the charging device in Embodiment 1.

Figure 12:
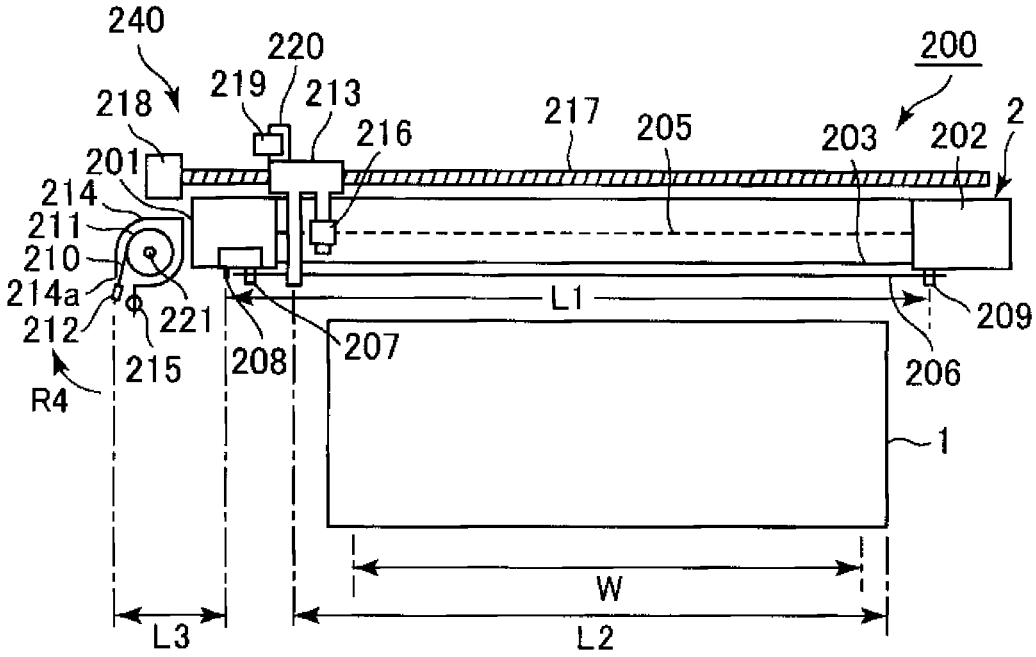

FIG. 12 is a schematic sectional view of a charging device with respect to a longitudinal direction in Embodiment 2.

Figure 13:
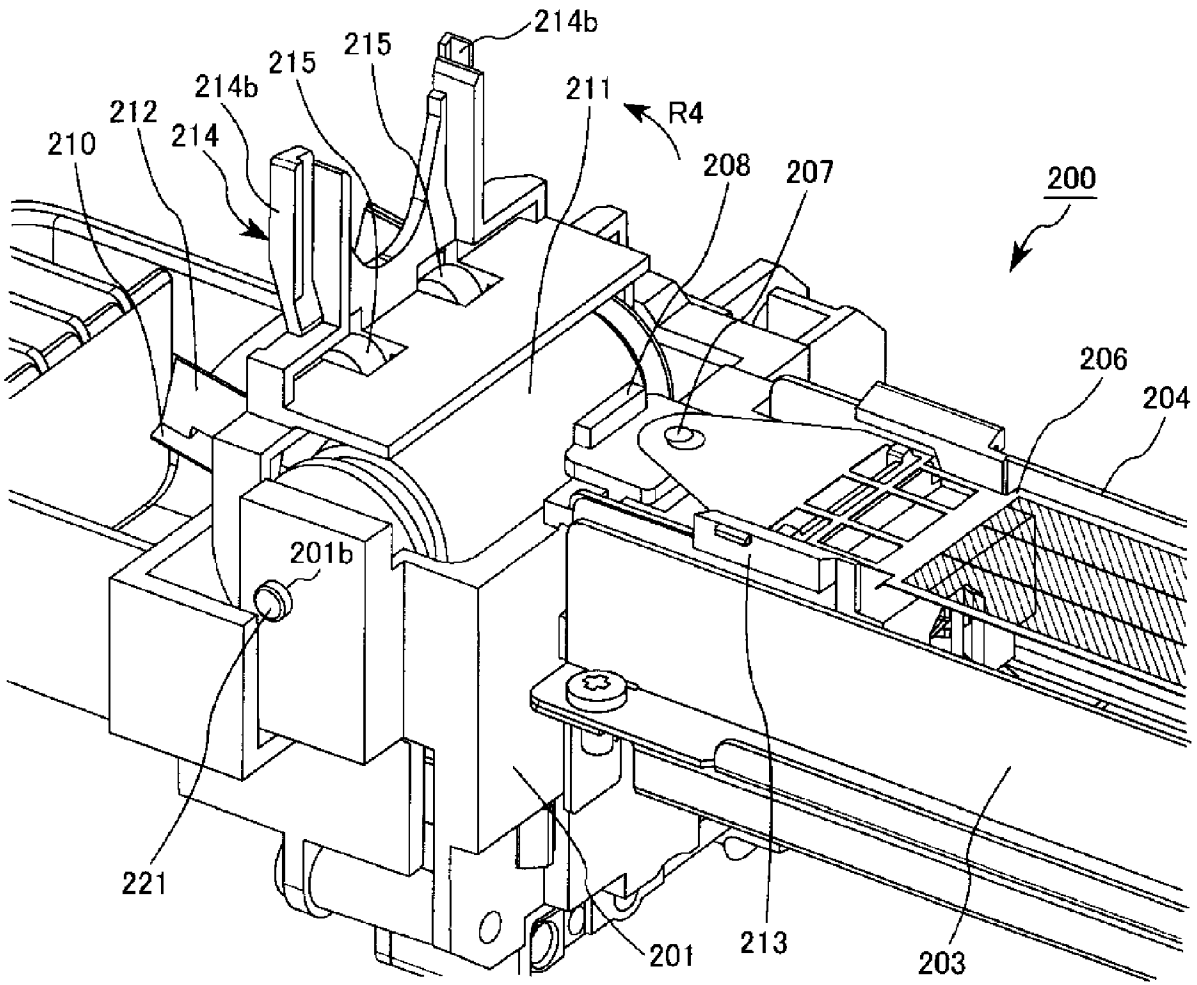

FIG. 13 is an enlarged perspective view showing the neighborhood of a shutter opening operation end position in the charging device in Embodiment 2.

Figure 14:
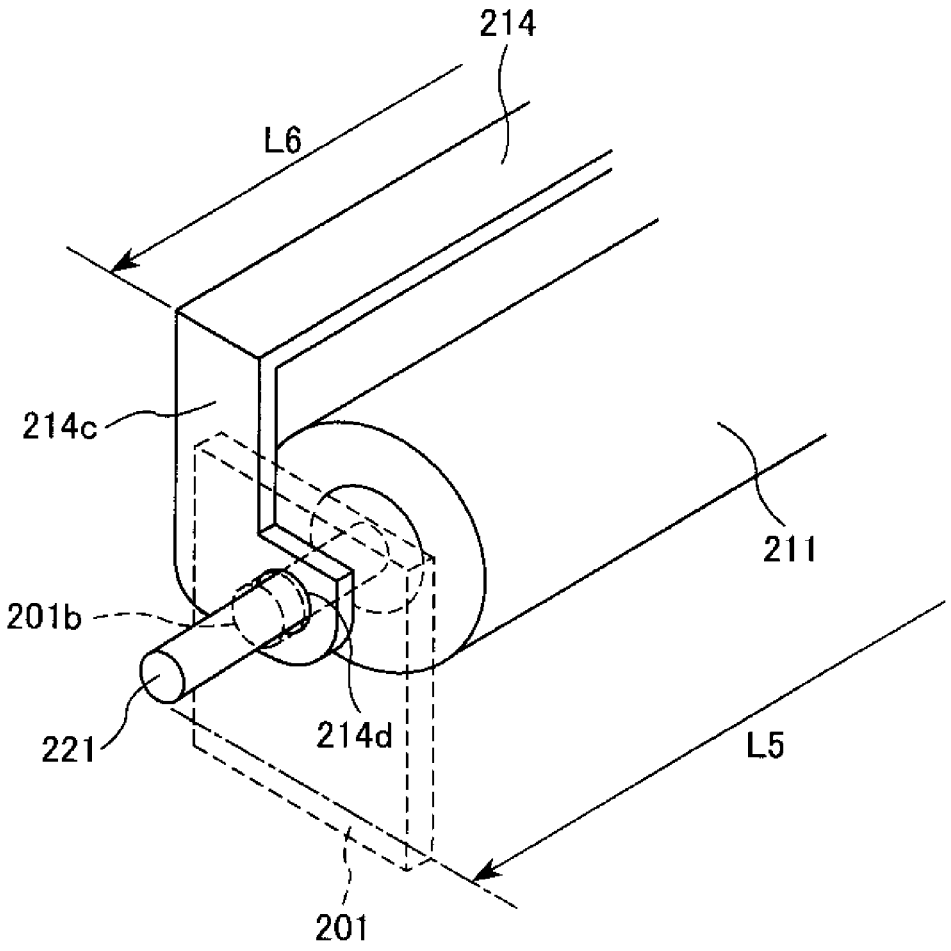

FIG. 14 is a schematic enlarged perspective view of a holding case and a winding-up mechanism in the charging device in Embodiment 2.

Figure 16:
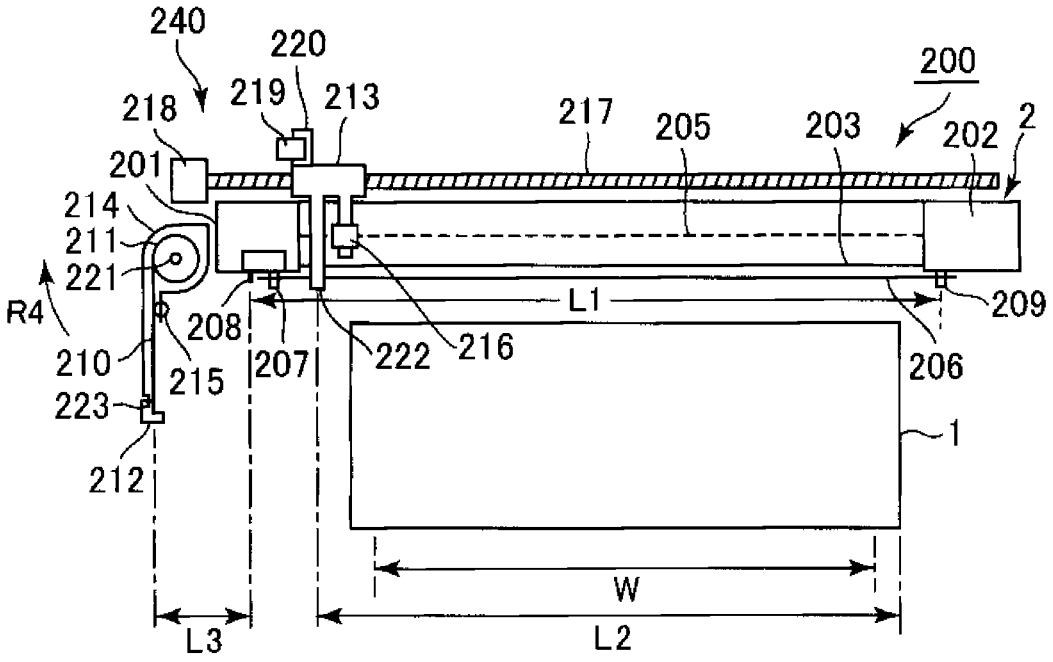
Figure 15:
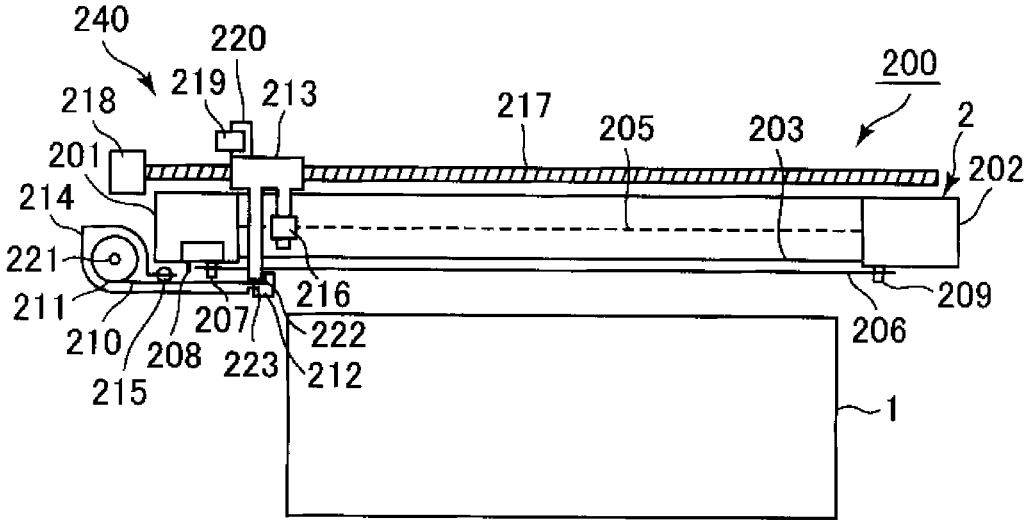
Figure 15:
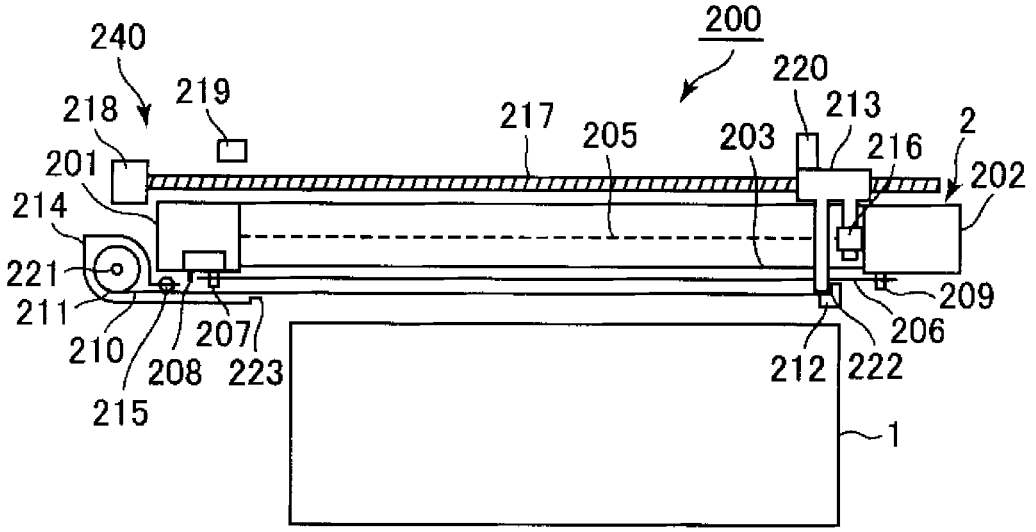

Parts (a) and (b) of FIG. 15 and FIG. 16 are schematic sectional views each showing a charging device with respect to a longitudinal direction in Embodiment 3.

Figure 17:
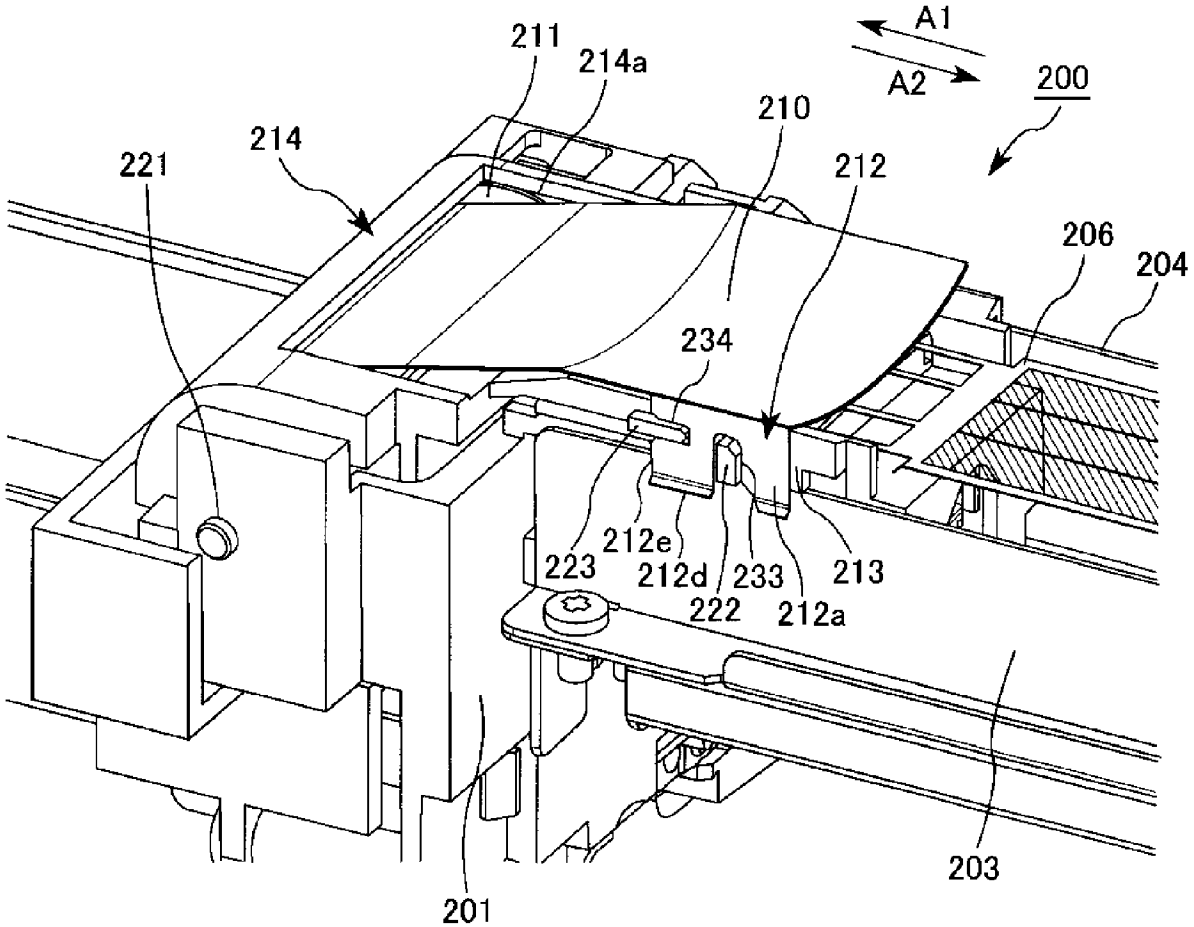
Figure 18:
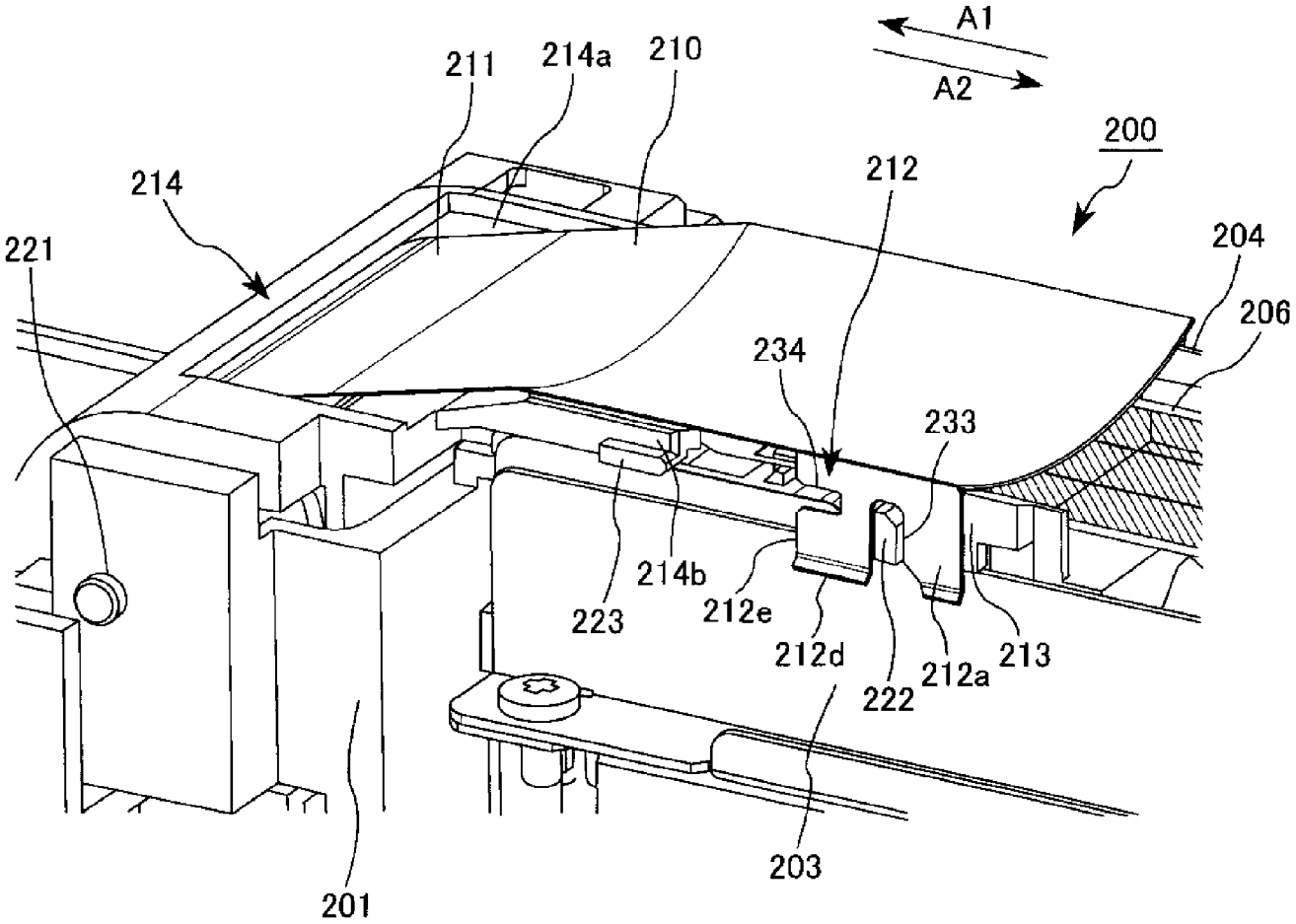
Figure 19:
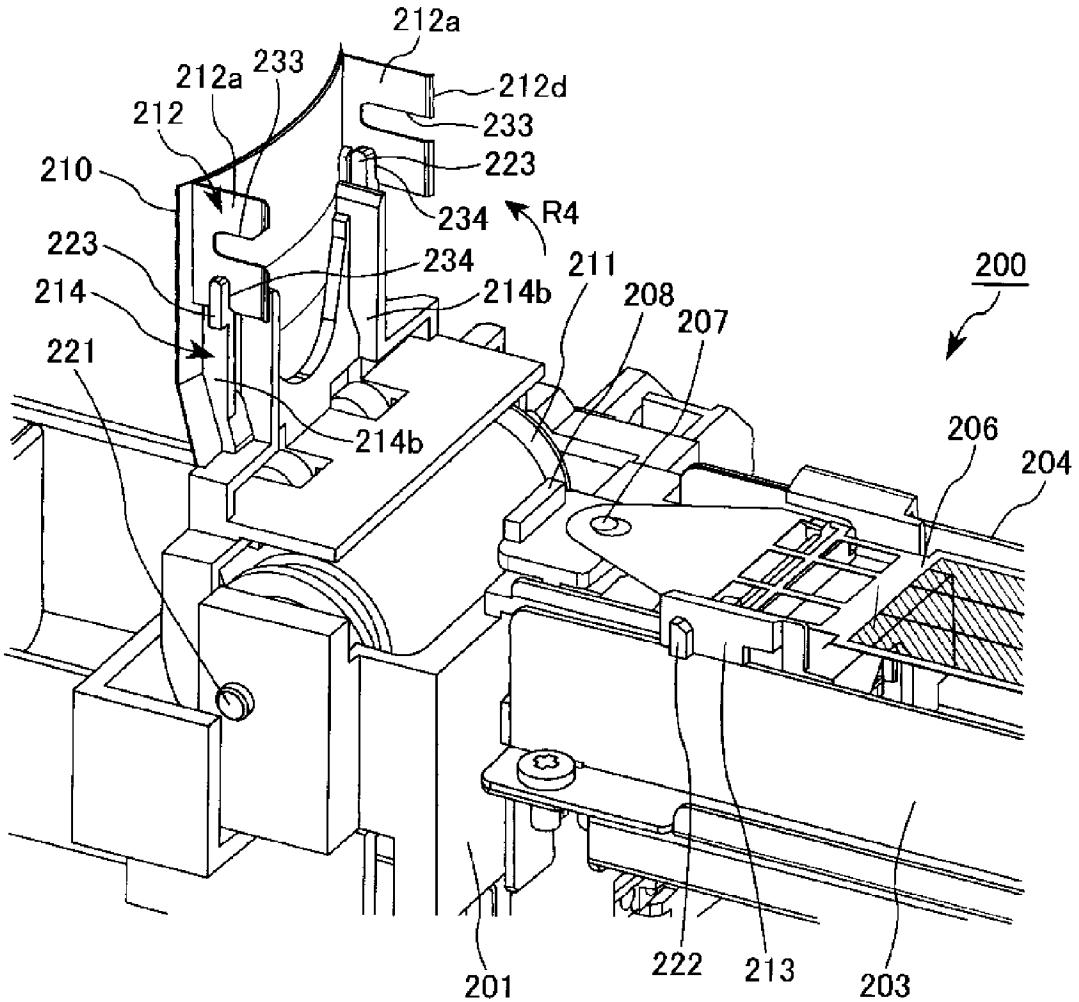

FIGS. 17, 18 and 19 are enlarged perspective views each showing the neighborhood of a shutter opening operation end position in the charging device in Embodiment 3.

Figure 20:
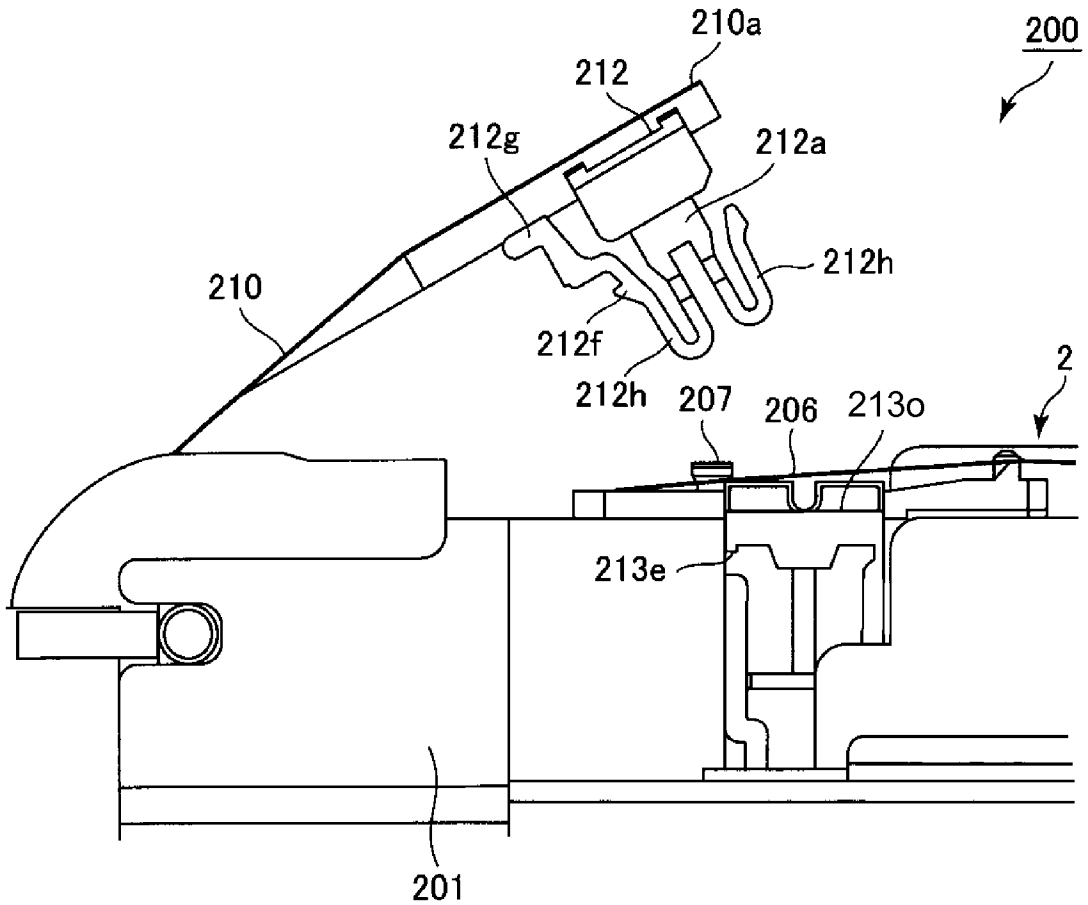

FIG. 20 is a schematic plan view of a charging device, as seen from a longitudinal direction, in a state in which a shutter of the charging device is separated from a moving portion in Embodiment 4.

Figure 21:
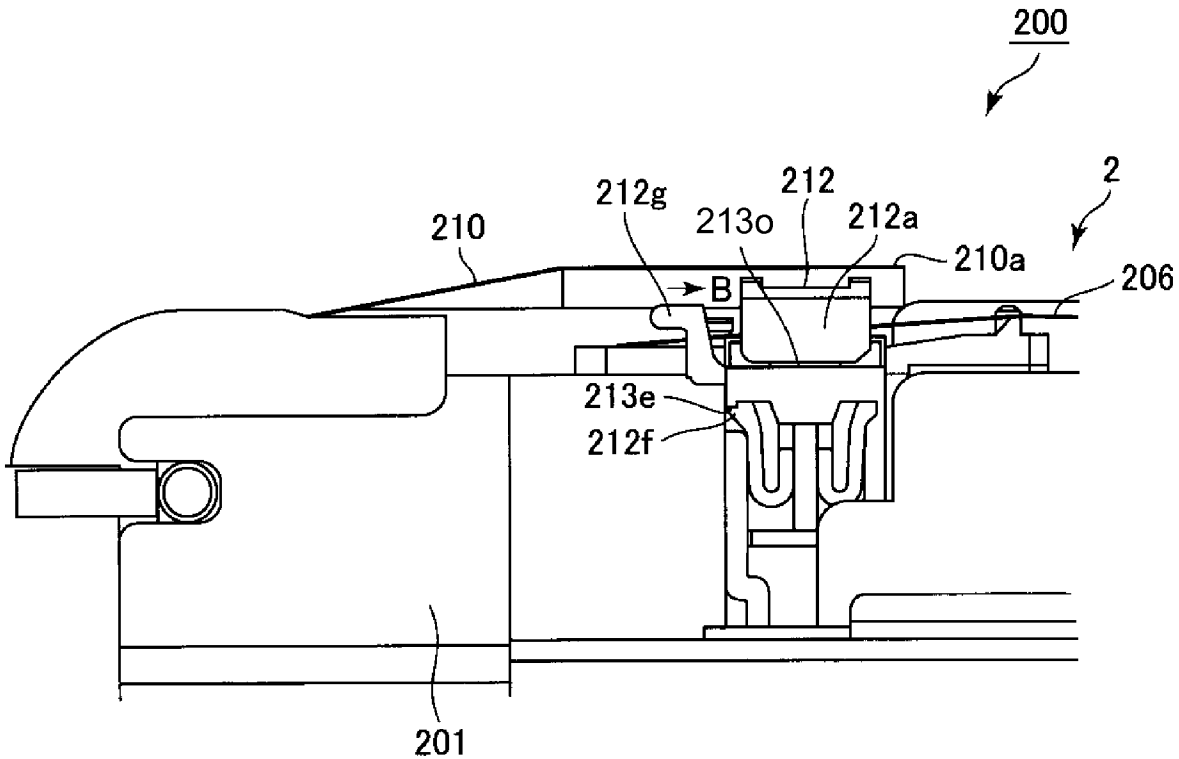

FIG. 21 is a schematic plan view of the charging device, as seen from the longitudinal direction, in a state in which the shutter of the charging device is connected with the moving portion in Embodiment 4.

DESCRIPTION OF THE EMBODIMENTS

A charging device as a charger according to the present invention will be specifically described with reference to the drawings.

(Embodiment 1)

1. Image Forming Apparatus

Figure 1:
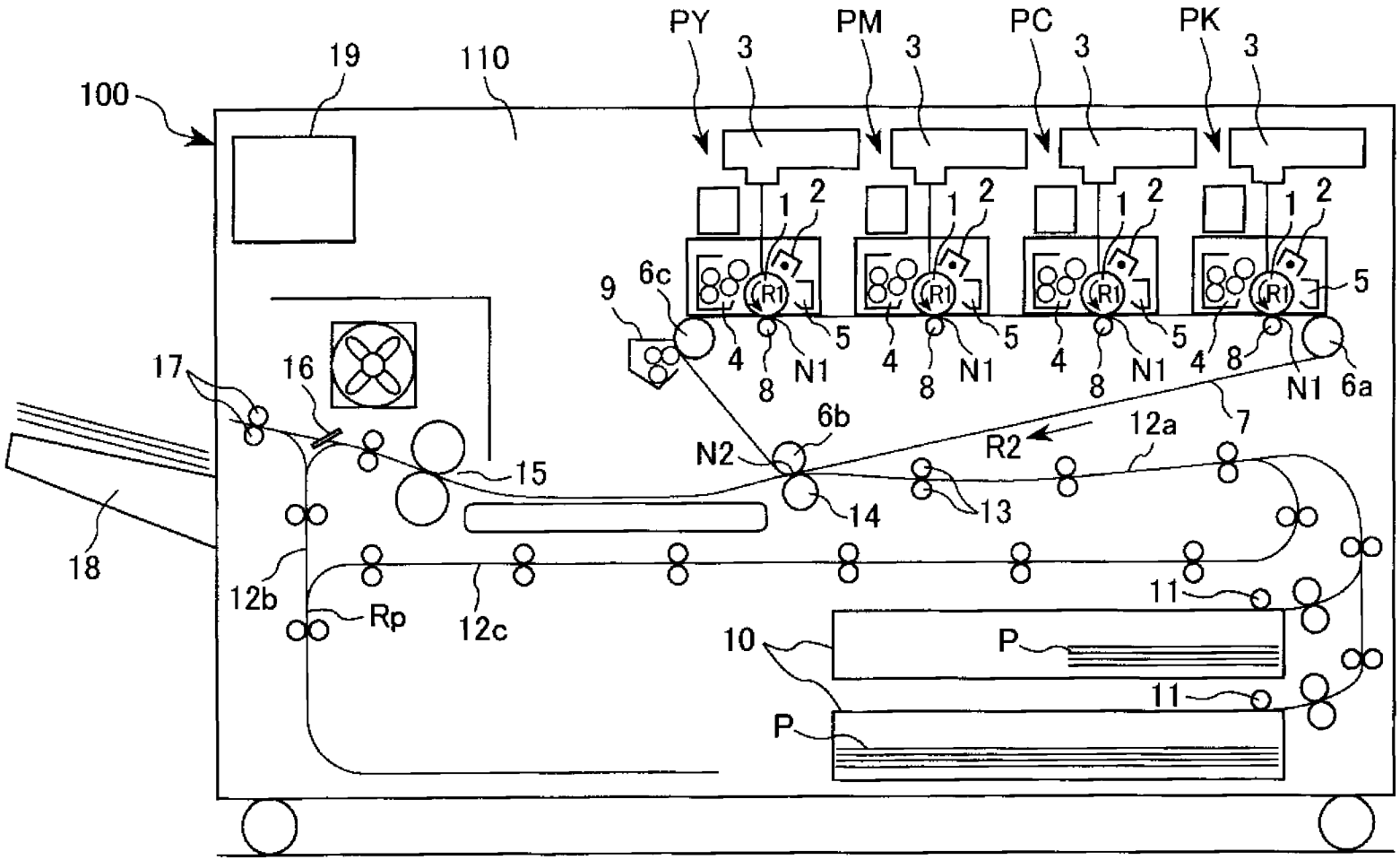
FIG. 1 is a schematic sectional view of an example of an image forming apparatus using a charging device according to the present invention in Embodiment 1.

First, an example of a constitution and an operation of an image forming apparatus using the charging device as the charger in this embodiment will be described. FIG. 1 is a schematic sectional view of an image forming apparatus 100 in this embodiment.

The image forming apparatus 100 in this embodiment is a laser printer capable of forming a full-color image by using an electrophotographic type. The image forming apparatus 100 forms four color toner images through processes of charging, exposure, development and transfer by first to fourth image forming portions PY, PM, PC and PK. Constitutions and operations of the respective image forming portions PY, PM, PC and PK are substantially the same except that colors of developers used are different from each other.

An apparatus main assembly 110 is provided with a controller (control circuit) 19 as a control means. The controller 19 includes a CPU and memories such as ROM and RAM. The controller 19 successively actuates, when a print command signal outputted from an external device (not shown) such as a host computer is inputted into the controller 19, the image forming portions PY, PM, PC and PK in accordance with an image formation control sequence stored in the memories.

First, in each of the image forming portions PY, PM, PC and PK, a drum-type photosensitive member (photosensitive drum) as an image bearing member is rotationally driven in an arrow R1 direction in FIG. 1 at a predetermined peripheral speed (process speed). Further, an endless belt-shaped intermediary transfer belt 7 as an intermediary transfer member provided opposed to the photosensitive members 1 of the image forming portions PY, PM, PC and PK is rotationally driven at a peripheral speed corresponding to the rotational peripheral speed of each of the photosensitive members 1. The intermediary transfer belt 7 is stretched around a driving roller 6*a*, a follower roller 6*b* and a tension roller 6*c*, and is rotationally driven in an arrow R2 direction in FIG. 1 by transmitting a driving force to the driving roller 6*a*.

Then, at the image forming portion PY for yellow as a first color, an outer peripheral surface of the photosensitive member 1 is electrically charged uniformly to a predetermined polarity and a predetermined potential by a charging device 200 (FIG. 2 etc.) including a corona charger 2 as a charger. Then, the surface of the charged photosensitive member 1 is subjected to scanning exposure to laser light generated by an exposure device (laser scanner 3) as an exposure means on the basis of image information from the external device. As a result, an electrostatic (latent) image depending on the image information is formed on the surface of the photosensitive member 1. Then, the electrostatic image is developed with a yellow toner as the developer by a developing device 4 as a developing means, so that a yellow toner image (developer image) is formed on the surface of the photosensitive member 1.

Similar steps of the charging, the exposure and the development are also performed at each of the image forming portion PM for magenta as a second color, the image forming portion PC for cyan as a third color and the image forming portion PK for black as a fourth color.

The color toner images formed on the surfaces of the photosensitive members 1 of the image forming portions PY, PM, PC and PK are successively transferred (primary-transferred) superposedly onto the outer peripheral surface of the intermediary transfer belt 7 at respective primary transfer portions N1. At each of the primary transfer portions N1, a primary transfer roller 8 which is a roller-shaped transfer member as a primary transfer means is provided opposed to the photosensitive member 1 via the intermediary transfer belt 7. The primary transfer roller 8 presses the intermediary transfer belt 7 against the photosensitive member 1 to form a nip at the primary transfer portion N1. Thus, a full-color toner image is formed on the surface of the intermediary transfer belt 7. A toner (primary transfer residual toner) remaining on the surface of the photosensitive member 1 after the primary transfer is removed and collected by a drum cleaner 5 as a photosensitive member cleaning means. Thereafter, the photosensitive member 1 is subjected to subsequent image formation.

On the other hand, a recording material P is conveyed from a feeding cassette 10 to a registration roller pair 13 via a conveyance passage 12*a* by a feeding roller 11 and the like. Then, the recording material P is conveyed to a secondary transfer portion N2 by the registration roller pair 13. At the secondary transfer portion N2, a secondary transfer roller 14 which is a roller-shaped transfer member as a secondary transfer means is provided opposed to the follower roller 6*b* via the intermediary transfer belt 7. The secondary transfer roller 14 presses the intermediary transfer belt 7 against the follower roller 6*b* to form a nip at the secondary transfer portion N2. Then, in a process in which the recording material P is nipped and conveyed through the secondary transfer portion N2, the toner image is transferred (secondary-transferred) from the surface of the intermediary transfer belt 7 onto the surface of the recording material P. At toner (secondary transfer residual toner) remaining on the surface of the intermediary transfer belt 7 is removed and collected by a belt cleaner 9 as an intermediary transfer member cleaning means. Thereafter, the intermediary transfer belt 7 is subjected to subsequent image formation.

The recording material P on which the unfixed toner image is carried is introduced, in a state in which an image carrying surface thereof is directed upward, into a nip formed between a fixing roller pair of a fixing device as a fixing means. Then, the recording material P is heated and pressed by being nipped and conveyed through the nip of the fixing device 15, so that the toner image is fixed on the recording material P.

In the case where the image is formed on an only one surface of the recording material P, the recording material P discharged from the fixing device 15 is passed through a discharging roller pair 17 by a switching flapper 16, thus being discharged onto a discharge tray 18 provided on a side surface of the apparatus main assembly 100.

On the other hand, in the case where the image is formed on both surfaces of the recording material P, the recording material P discharged from the fixing device 15 is guided into a reverse conveyance passage 12*b* by the switching flapper 16. In the reverse conveyance passage 12*b*, switch-back of the recording material P is made when a trailing end of the recording material P with respect to a traveling (movement) direction reaches a reversing point Rp. As a result, the recording material P is sent to a conveyance passage 12*c* for double-side (surface) printing in a state in which the image carrying surface (first surface) is directed upward. The recording material P sent to the conveyance passage 12*c* is conveyed to the registration roller pair 13 via the conveyance passage 12*b*. Thereafter, the recording material P is set to the secondary transfer portion N2 by the registration roller pair 13. Then, onto a back surface (second surface) of the recording material P, in a process in which the recording material P is nipped and conveyed through the secondary transfer portion N2, a toner image is transferred (secondary-transferred) from the surface of the intermediary transfer belt 7. Thereafter, the recording material P on which the unfixed toner image is carried at the second surface thereof is introduced, in a state in which the image carrying surface (second surface) is directed upward, into the nip formed between the fixing roller pair of the fixing device 15. Then, the recording material P is heated and pressed by being nipped and conveyed through the nip of the fixing device 15, so that the toner image is fixed on the second surface of the recording material P. Then, the recording material P discharged from the fixing device 15 is passed through the discharging roller pair 17 by the flapper 16, thus being discharged onto the discharge tray 18.

2. Charging Device (Apparatus)

Figure 2:
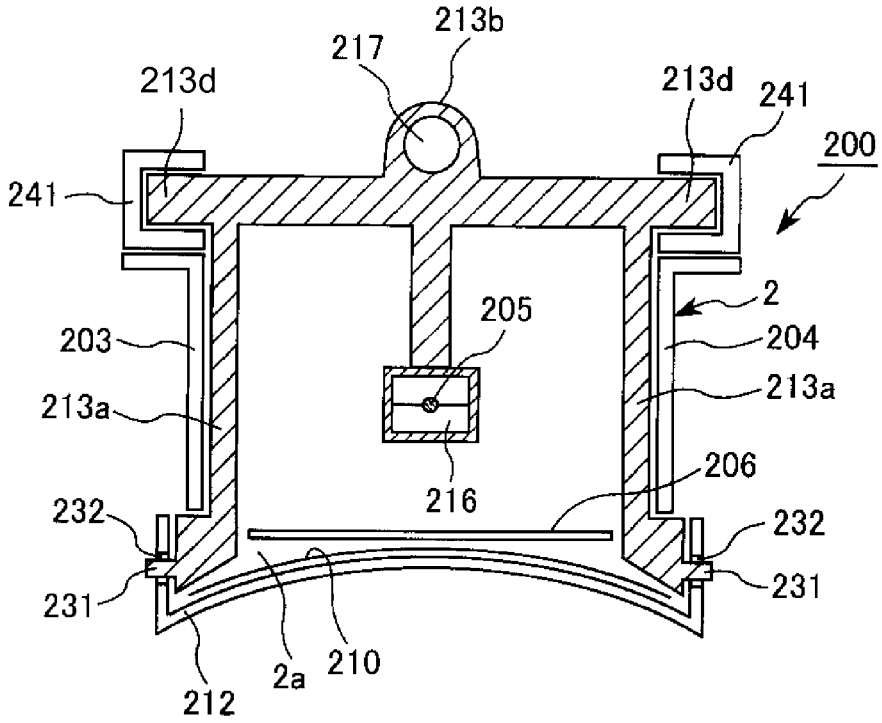
FIG. 2 is a schematic sectional view of the charging device with respect to a widthwise direction in Embodiment 1.

Next, the charging device 200 as a charger in this embodiment will be described. FIG. 2 is a schematic sectional view of the charging device 200 with respect to a direction perpendicular to a rotational axis direction (longitudinal direction) of the photosensitive member 1. Parts (a) and (b) of FIG. 3 are schematic sectional view of the charging device 200 with respect to the rotational axis direction of the photosensitive member 1. FIG. 4 is a perspective view of the charging device 200 as seen from a photosensitive member 1 side. Here, (a) of FIG. 3 shows the charging device 200 in an open state of a shutter 210 described later, and (b) of FIG. 3 shows the charging device 200 in a closed state of the shutter 210.

Incidentally, a left side of the charging device 200 in FIG. 3 and the like is referred to as a front side, and a right side is referred to as a rear side. The front side of the charging device 200 corresponds to a front side of the image forming apparatus 100 as the front side of the drawing sheet of FIG. 1.

The charging device 200 includes the corona charger 2, disposed opposed to the photosensitive member 1, for electrically charging the photosensitive member 1. In this embodiment, the corona charger 2 is of a scotron type. That is, the corona charger 2 includes a discharging wire 205 as a discharging electrode for generating corona discharge, electroconductive shields 203 and 204, and a grid electrode 206 as a grid which is a control electrode for controlling a charge potential of the photosensitive member 1 as a member-to-be-charged. Further, the control 2 includes a front block 201 and a rear block 202, as a supporting member. Further, the shields 203 and 204 are supported at longitudinal end portions thereof by the front block 201 and the rear block 202, and are disposed substantially in parallel to and opposed to each other via the discharging wire 205. Further, the discharging wire 205 is stretched between the front block 201 and the rear block 202, and is provided along the longitudinal direction of the corona charger 2. The shields 203 and 204, the front block 201 and the rear block 202 constitute a casing for surrounding the discharging electrode. The grid electrode 206 is located at an opening 2*a*, of the corona charger 2 opposing the photosensitive member 1, formed by edge portions of the shields 203 and 204 in the photosensitive member 1 side, an edge portion of the front block 201 and an edge portion of the rear block 202, and is disposed between the discharging wire 205 and the photosensitive member 1. As further described later, the grid electrode 206 is stretched between the front block 201 and the rear block 202 via a front grid supporting portion 207 as a first supporting portion and a rear grid supporting portion 209 as a second supporting portion which are provided on the front block 201 and the rear block 202, respectively, and are provided along the longitudinal direction of the corona charger 2. As the grid electrode 206, a metal plate provided with a plurality of lattice- or grill-shaped openings, wires arranged in a lattice shape or a mesh-shape, and the like are used.

Incidentally, as the shield, in addition to the side portion shields 203 and 204 extending in a substantially radial direction of the photosensitive member 1, a top portion shield provided opposed to the photosensitive member 1 with respect to the discharging wire 205 may also be disposed. In this case, a cross section of the shield as a whole with respect to a direction substantially perpendicular to the rotational axis direction of the photosensitive member 1 is a substantially U shape.

The corona charger 2 is disposed along the rotational axis direction of the photosensitive member 1, and the longitudinal direction of the corona charger 2 is in a substantially parallel relationship with the rotational axis direction of the photosensitive member 1. The corona charger 2 is connected with a charging power source (not shown) as a charging bias applying means, and by applying a DC voltage to the discharging wire 205 and the grid electrode 206, the surface of the photosensitive member 1 is electrically charged uniformly to a negative predetermined potential.

3. Demounting and Mounting Method of Grid Electrode

Next, a demounting and mounting method of the grid electrode 206 will be described. Part (a) of FIG. 5 is sectional view of the charging device 200 in the neighborhood of the front grid supporting portion 207 for supporting a front end portion of the grid electrode 206, and (b) of FIG. 5 is a sectional view of the charging device 200 in the neighborhood of the rear grid supporting portion 209 for supporting a rear end portion of the grid electrode 206.

As shown in (b) of FIG. 5, the rear grid supporting portion 209 as the second supporting portion is a part of a rear grid supporting member 229 which is a supporting mechanism as a supporting means for the grid electrode 206, and the rear grid supporting member 229 is fixed on the rear block 202. The rear grid supporting portion 209 which is a projection provided and projected toward the photosensitive member 1 is engaged with a rear fixing hole 230 which is a hole provided and penetrated in a thickness direction in the neighborhood of the rear end portion of the grid electrode 206.

On the other hand, as shown in (a) of FIG. 5, the front grid supporting portion 207 as the first supporting portion is a part of a front grid supporting member 224 which is a supporting mechanism as a supporting means for the grid electrode 206. The front grid supporting portion 207 which is a projection provided and projected toward the photosensitive member 1 is engaged with a front fixing hole 228 which is a hole provided and penetrated in a thickness direction in the neighborhood of the front end portion of the grid electrode 206. The front grid supporting member 224 is supported rotatably (swingably) relative to the front block 201 about an engaging hole 225 as a rotation center by being engaged at a locking portion 227 thereof with the engaging hole 225 provided in the front block 201. Further, the front grid supporting member 224 is urged, by a spring 226 as an urging means, in an arrow R3 direction in the figure, i.e., in a direction in which the front grid supporting portion 207 is to be rotated so as to be spaced from the rear grid supporting portion 209.

Then, the front grid supporting portion 207 applies a force to the grid electrode 206 in the arrow R3 direction in (a) of FIG. 5 by the rotation of the front grid supporting member 224 in the arrow R3 direction in the figure by an urging force of the urging means. As a result, the grid electrode 206 is stretched by the front grid supporting portion 207 and the rear grid supporting portion 209.

Incidentally, a position of the grid electrode 206 relative to the photosensitive member 1 at the 2*a* of the corona charger 2 is determined by a positioning projection 202*a* provided on the rear block 202.

In the case where the grid electrode 206 is demounted from the corona charger 2, a knob 208 as an operating portion provided on the front grid supporting member 224 while being projected toward the photosensitive member 1 is operated, so that the front grid supporting member 224 is rotated in an opposite direction to the arrow R3 direction in (a) of FIG. 5. In this embodiment, the knob 208 is used as the operating portion. However, a shape of the operating portion is not limited to a knob shape projected toward the photosensitive member 1, but the operating portion may also have, e.g., a structure such that an end portion of the front grid supporting member 224 in a shutter opening side can be urged toward a shutter closing direction by a finger of an operator. The operating portion may have any shape of the operating portion is located downstream of the front grid supporting portion 207 with respect to the shutter opening direction and the front grid supporting portion 207 can be moved to a position where the front grid supporting portion 207 and the grid electrode 206 are detachably mountable. Further, the operating portion may also be provided as a member separate from a member provided with the front grid supporting portion 207. As a result, engagement between the front grid supporting portion 207 and the front fixing hole 228 can be eliminated. Further, by this operation, tension applied to the grid electrode 206 is eliminated, so that engagement between the rear grid supporting portion 209 and the rear fixing hole 230 can also be eliminated. As a result, the grid electrode 206 can be demounted from the corona charger 2.

Also in the case where the grid electrode 202 is mounted in the corona charger 2, similarly as in the above-described case, the knob 208 as the operating portion is operated, so that the front grid supporting member 224 is rotated in the opposite direction to the arrow R3 direction in (a) of FIG. 5. Then, in that state, the front grid supporting portion 207 and the front fixing hole 228 are engaged with each other, and the rear grid supporting portion 209 and the rear fixing hole 230 are engaged with each other.

4. Shutter and Moving Mechanism Thereof

Next, a sheet-shaped shutter 210 for shielding the opening 2*a* of the corona charger 2 opposing the photosensitive member 1 and a moving mechanism thereof will be described.

The charging device 200 includes the sheet-shaped shutter 210, provided between the grid electrode 206 and the photosensitive member 1, for opening and closing the opening 2*a* of the corona charger 2. The shutter 210 is formed with a non-endless sheet-shaped member capable of being wound up in a roll shape. As the sheet-shaped member, a flexible resin-made film (sheet) or nonwoven fabric may suitably be used. By using such a sheet-like member, the shutter 210 can move in a narrow space between the photosensitive member 1 and the grid electrode 206. Further, the shutter 210 is retracted in a roll shape toward a longitudinal end of the corona charger 2, so that a space during retraction can be made small. For example, as the shutter 210, a 30 μm-thick sheet-shaped member formed of polyimide resin can be used.

Part (a) of FIG. 3 shows a state in which the shutter 210 is opened by winding up the shutter 210 along the longitudinal direction of the corona charger 2 so as to be moved in an arrow A1 direction (opening direction) in the figure. On the other hand, (b) of FIG. 3 shows a state in which the shutter 210 is closed by pulling the shutter 210 along the longitudinal direction of the corona charger 2 so as to be moved in an arrow A2 direction (closing direction) in the figure. The shutter 210 is wound up from the rear block 202 side to the front block 201 side and is pulled from the front block 201 side to the rear block 202 side.

The shutter 210 prevents drop of the corona product from the corona charger 2 toward the photosensitive member 1, e.g., during OFF state of the power source of the apparatus main assembly 110. Accordingly, the shutter 210 may only be required that the shutter 210 can open and close (shield) at least a region where the member 1 opposes a charging region W by the corona charger 2. Typically, the shutter 210 opens and closes (shields) a substantially whole region with respect to a widthwise direction of the opening 2*a* and a substantially whole region with respect to a longitudinal direction of the opening 2*a*.

The shutter 210 is wound up by and accommodated in a winding-up mechanism 211 as a winding-up portion provided in the charging device 200. The winding-up mechanism 211 is disposed outside the front grid supporting member 224 provided on the front block 201 with respect to the longitudinal direction of the corona charger 2. The winding-up mechanism 211 is urged in a winding-up direction of the shutter 210 by a helical coil spring (not shown) as an urging portion provided inside the support mechanism 211. A rotation shaft 221 of the winding-up mechanism 211 is supported, by the front block 201, rotatably about an axis substantially perpendicular to the longitudinal direction of the corona charger 2. Further, the winding-up mechanism 211 winds up the shutter 210 so that the surface of the shutter 210 opposing the photosensitive member 1 in a state in which the shutter 210 is closed is an outermost surface in a state in which the shutter 210 wound up.

In the neighborhood of a leading end portion 210*a* of the shutter 210 with respect to the closing direction, a connecting portion 212 is fixed. FIG. 6 is a perspective view of the connecting portion 212. The connecting portion 212 is formed with a metal plate which is a metal-made thin plate having a spring property. The connecting portion 212 is prepared by integrally forming side portions 212*a* and 212*a* as projected portions provided in substantially parallel with the shields 203 and 204, respectively, and a fixing portion 212*b* provided so as to bridge the side portions 212*a* and 212*a*. Further, on a surface (fixing surface) 212*c* of the fixing portion 212*b* in the member 1 side, a surface (surface-to-be-fixed) 210*b* of the shutter 210 in a side opposite from the photosensitive member 1 in a predetermined range from the leading end portion 210*a* of the shutter 210 with respect to the closing direction is fixed by a proper fixing means such as bonding or welding (bonding in this embodiment).

The fixing portion 212*b* is curved so that a central portion is more spaced from the member 1 than end portions close to the side end portions 202*a* and 202*a* (i.e., widthwise end portions of the corona charger 2), i.e., is projected toward the grid electrode 206. As a result, a shape of the shutter 210 is regulated (limited) by providing a curvature shape such that the central portion is more spaced, toward the leading end portion 210*a* of the shutter 210 with respect to the closing direction, than the end portions with respect to a surface movement direction (circumferential direction) of the photosensitive member 1 (i.e., such that the central portion is more projected toward the grid electrode 206 than the end portions of the shutter 210 with respect to the widthwise direction). Further, in this state, when the shutter 210 is pulled out from the winding-up mechanism 211, a pulled-out portion of the shutter 210 is provided with a curvature shape substantially equal to the above-described curvature shape by stiffness of the shutter 210. Thus, the connecting portion 212 also functions as a shape regulating (limiting) means for imparting the curvature shape to the leading end portion of the shutter 210 with respect to the closing direction. If the shutter 210 can be disposed as desired in a space between the photosensitive member 1 and the corona charger 2, the curvature of the leading end portion of the shutter 210 with respect to the closing direction may also be nonequal to the curvature of the peripheral surface of the photosensitive member 1.

In this embodiment, the side end portions 212*a* and 212*a* are inclined in a direction in which edges 212*d* and 212*d* opposite from the fixing portion 212*b* approach each other in a state before the connecting portion 212 is mounted on a moving member 213, described later as a mounting portion, which constitutes a mounting mechanism. Further, by mounting the connecting portion 212 on the moving member 213, the connecting portion 212 is elastically deformed so that the edges 212*d* and 212*d* of the side end portions 212*a* and 212*a* are spaced from each other, with the result that the side end portions 212*a* and 212*a* are disposed in substantially parallel to each other. As a result, when the connecting portion 212 is mounted on the moving member 213, the side end portions 212*a* and 212*a* sandwich the moving member 213 at a predetermined force. Further, in this embodiment, the side end portions 212*a* and 212*a* are curved in a predetermined range close to the edges 212*d* and 212*d* with respect to a direction in which the side end portions 212*a* and 212*a* are spaced from each other. As a result, when the connecting portion 212 is slid and mounted on the moving member 213, the curved portions thereof function as a guide, so that the connecting portion 212 is easily mounted on the moving member 213.

Further, engaging holes 232 and 232 each penetrating through the side end portion 212*a* in a thickness direction are provided in the side end portions 212*a* and 212*a* adjacently to connection portions (bent portions) of the side end portions 212*a* and 212*a* with the fixing portion 212*b*.

On the other hand, the connecting portion 200 includes a shutter opening and closing mechanism 240 as a moving portion for moving the shutter 210 along the longitudinal direction of the corona charger 2 to open and close the shutter 210. Referring to FIG. 3, the shutter opening and closing mechanism 240 includes an opening and closing motor 218 as a driving means (driving source), the moving member 213, a feeding screw 217 as a drive transmission means, and the like. Further, the shutter opening and closing mechanism 240 includes a home position sensor 219 and a detecting flag 220 which constitute a shutter opening and closing detecting means for detecting an end of an opening operation of the shutter 210.

Referring to FIG. 2, the moving member 213 includes holding portions 213*a* and 213*a*, provided adjacently to the shields 203 and 204 in widthwise end portion sides of the opening 2*a*, for holding the connecting portion 212. The holding portions 213*a* and 213*a* extend to positions closer to the photosensitive member 1 than edges of the shields 203 and 204 in the photosensitive member 1 side. Further, the moving member 213 includes a drive transmitting portion 213*b* threadably engaged with the feeding screw 217 at a connecting portion provided so as to bridge the holding portions 213*a* and 213*a*. The moving member 213 is drive-connected with the feeding screw 217 via the drive transmitting portion 213*b*. Further, the charging device 200 is provided with rails 241 and 241 are provided adjacently to the shields 203 and 204 at end portions in a side opposite from the photosensitive member 1. Further, engaging portions 213*d* and 213*d* of the moving member 213 are slidably engaged with the rails 241 and 241, the moving member 213 can be moved substantially only in a direction along the longitudinal direction of the corona charger 2.

The connecting portion 212 is separably connected with the holding portions 213*a* and 213*a* of the moving member 213. In this embodiment, engaging projections (supporting portions) 231 and 231 as an engaging portion provided on the holding portions 213*a* and 213*a* of the moving member 213 are engaged with the engaging holes 232 and 232 as an engaging portion provided at the end portions 212*a* and 212*a* of the connecting portion 212. As a result, the connecting portion 212 is connected with and held by the moving member 213. The engaging projections 231 and 231 are provided and projected toward an outside of the opening 2*a* along the widthwise direction of the opening 2*a*, at portions, closer to the photosensitive member 1 than the shields 203 and 204, of the holding portions 213*a* and 213*a* of the moving member 213.

The connecting portion 212 and the moving member 213 are connected with each other, and are moved in synchronism with each other, pulling and insertion of the shutter 210 relative to the winding-up mechanism 211 are effected, so that opening and closing of the shutter 210 are performed.

Incidentally, a cleaning pad 216 for cleaning the discharging wire 205 is mounted on the moving member 213, and an opening and closing operation of the shutter 210 and a cleaning operation of the discharging wire 205 may also be performed simultaneously by the single moving member 213.

The winding-up mechanism 211 as the winding-up portion is supported by the front block 201 together with a holding case 214 for holding the winding-up mechanism 211. The holding case 204 includes a pulling-out portion 214*a* as an opening for permitting pulling-out of the shutter 210 which is wound up by the winding-up mechanism 211 and which is accommodated therein. Further, a guide roller 215 as a guide member is rotatably supported by the holding case 214 in the neighborhood of the pulling-out portion 214*a* in the grid electrode 206 side with respect to the longitudinal direction of the corona charger 2. The guide roller 215 is rotatable in contact with the shutter 210 in a side opposite from the photosensitive member 1. The guide roller 215 suppress breaking of the shutter 210 by contact with the edge of the grid electrode 206, the front grid supporting portion 207, the knob 208 and the like. For that reason, the guide roller 215 is disposed higher (closer to the photosensitive member 1) than these portions toward the photosensitive member 1, and has a guiding function of guiding the surface of the shutter 210 while covering the shutter surface from contact with these portions. Further, the guide roller 215 also has the function of smoothing the operation of the shutter 210.

Further, in this embodiment, the holding case 214 is provided with a cover portion (contact preventing cover portion) 214*b* (FIG. 11) extended closer to the grid electrode 206 than the guide roller 215 in the longitudinal direction of the corona charger 2. The cover portion 214*b* is disposed adjacently to the shields 203 and 204 so as to sandwich the front grid supporting portion 207, the knob 208 and the front end portion of the grid electrode 206 at the widthwise central portion of the opening 2*a*. Further, the cover portion 214*b* is disposed so as to be higher toward (closer to) the photosensitive member 1 than the grid electrode 206, the front grid supporting portion 207, the knob 208 and the like. As a result, the shutter 210 can further suppress the breaking thereof by contact with the edge of the grid electrode 206, the front grid supporting portion 207, the knob 208 and the like. When a closing direction leading end portion of the shutter 210 is positioned in an opening operation and position where the movement of the shutter 210 in the opening direction is ended, a front end portion of the holding portion 213*a* of the moving member 213 and a rear end portion of the cover portion 214*b* are in contact with each other (FIG. 11).

Incidentally, in a state in which the shutter 210 is pulled out, i.e., during the operation of the shutter 210 or when the closing direction leading end portion of the shutter 210 is disposed in a closing operation end position, where the movement of the shutter 210 in the closing direction is ended, a position of the shutter 210 in the winding-up mechanism 211 side with respect to the substantially radial direction is determined by the guide roller 215.

The moving member 213 is driven by the feeding screw 217 and the opening and closing motor 218, and is moved along the longitudinal direction of the corona charger 2 corresponding to the rotation axis direction of the photosensitive member 1. That is, on the peripheral surface of the feeding screw 217, spiral grooves are formed, and an end portion of the feeding screw 217 is drive-connected with the opening and closing motor 218. Then, when the feeding screw 207 is rotationally driven by the opening and closing motor 218, a driving force is transmitted to the moving member 213 via the drive transmitting portion 213*b*, of the moving member 213, threadably engaged with the spiral grooves of the feeding screw 217. As a result, the moving member 213 is moved in the arrow A1 direction (opening direction) in (a) of FIG. 2 or in the arrow A2 direction (closing direction) in (b) of FIG. 2 along the longitudinal direction of the corona charger 2. Further, as a result, the driving force is transmitted to the shutter 210 via the moving member 213 with respect to the opening and closing direction.

Further, the home position sensor 219 is disposed in a position where the home position sensor 219 can detect that the shutter 210 is in the open state. The home position sensor 219 includes a photo-interruptor. When the shutter 210 reaches the opening operation end position, the detecting flag 220 as a light-blocking member disposed on the moving member 213 shields (light-blocks) a detecting portion of the photo-interruptor of the home position sensor 219. As a result, it is possible to detect that the shutter 210 is in the home position, i.e., the opening operation end position. During the opening operation of the shutter 210, the opening and closing motor 218 is driven from the state, in which the shutter 210 is in the opening operation end position, by a predetermined amount (number of rotation), so that the closing operation of the shutter 210 can be ended in a state in which the shutter 210 reaches the closing opening end position.

Incidentally, in this embodiment, the connecting portion 212 is formed with the metal plate which is the metal-made thin plate having the spring property, but may also be formed with, e.g., of a film material having elasticity. Further, the formation of the connecting portion 212 is not limited to formation using an elastically deformable member. For example, in place of the engagement between the engaging projection 231 and the engaging hole 232 and sandwiching using the connecting portion 212, it is possible to use a proper detachably mountable fastening member or the like, such as a screw. In such a case, the connecting portion 212 may also be non-deformable elastically.

5. Shutter Operation Procedure

Next, an example of an operation procedure of the shutter 210 will be described. FIG. 7 is a schematic control block diagram showing a control embodiment according to the operation of the shutter 210. FIG. 8 is a flow chart showing an example of the operation procedure of the shutter 210.

As shown in FIG. 7, control of the opening and closing operation of the shutter 210 is effected by a controller 19, provided in the apparatus main assembly 110, for effecting integrated control of the operation of the image forming apparatus 100. The controller 19 contacts drive of the opening and closing motor 218 on the basis of a signal, outputted from the home position sensor 219, relating to a position of the shutter 210 to control the opening and closing operation of the shutter 210. The controller 19 executes control of the opening and closing operation of the shutter 210 in accordance with the contents of a control program stored in ROM.

Referring to FIG. 8, the controller 19 discriminates, when an image formation start signal is inputted (S100), whether or not the shutter 210 is in the opening operation end position, on the basis of the output of the home position sensor 219 (S101). The controller 19 disposes, in the case where the shutter 210 is not in the opening operation end position, the shutter 210 in the opening operation end position by executing the opening operation of the shutter 210 (S102). On the other hand, the controller 19 starts rotation of the photosensitive member 1 in the case where the shutter 210 is in the opening operation end position (S103). Thereafter, the controller 19 starts application of a charging bias to the control 2 (S104). Then, the controller 19 starts image formation as soon as a preparatory operation of other image forming devices is ended (S105).

When the controller 19 detects an end of the image formation for a job (a series of image forming operations by a single image formation start signal with respect to a single or plurality of recording materials (S106), the controller 19 stops the charging bias application to the corona charger 2 (S107) and then stops the rotation of the photosensitive member 1 (S108). Thereafter, the controller 19 drives, after the rotation of the photosensitive member 1 is stopped, the opening and closing motor 218 to rotate the feeding screw 217 in an opposite direction to the direction during the opening operation, thus executing the closing operation of the shutter 210 (S109).

Incidentally, in this embodiment, the closing operation of the shutter 210 is performed immediately after the image formation, but the present invention is not limited thereto. For example, the closing operation of the shutter 210 may also be performed after a lapse of a predetermined time after the end of the image formation. Further, the closing operation may also be performed during tuning-off provides of the power source of the apparatus main assembly 110 or after a lapse of a predetermined time after the turning-off process of the power source.

6. Separation of Connecting Portion

Next, separation of the connecting portion 212 for the moving member 213 performed before the demounting and mounting operation of the grid electrode 206 will be described. FIG. 9 is a schematic sectional view of the charging device 200 with respect to the rotational axis direction of the photosensitive member 1 during the demounting and mounting operation of the grid electrode 206 (in a state in which the connecting portion 212 is separated from the moving member 213). Further, FIGS. 10 and 11 are perspective views of the front block 201 and the neighborhood thereof of the charging device 200 as seen from the photosensitive member 1 side in a state in which the connecting portion 212 is connected with the moving member and in a state in which the connecting portion 212 is separated from the moving 213, respectively.

As shown in FIG. 9, with respect to the longitudinal direction of the corona charger 2, a region, necessary to be exposed for demounting and mounting the grid electrode 206, between the spaced supporting mechanisms for the grid electrodes 206 which are disposed at the end portions with respect to the longitudinal direction has a distance L1. In this embodiment, the distance L1 between the supporting mechanisms is represented by a distance from the knob 208, as the operating portion of the front grid supporting member 224 provided on the front block 201, to the rear grid supporting portion 209 of the rear grid supporting member 229 provided on the rear block 202.

Further, as shown in FIG. 9, with respect to the longitudinal direction of the corona charger 2, a movement region L2 of the holding portion 213*a* of the moving member 213 with which the connecting portion 212 is to be connected is shorter than the above-described distance L1 between the supporting mechanisms and thus is included in the distance L1. The movement region L2 corresponds to a movement region of the leading end portion 210*a* of the shutter 210 with respect to the closing direction in the state in which the connecting portion 212 is connected with the moving member 213. For that reason, as shown in (a) of FIG. 8 and FIG. 10, in the state in which the connecting portion 212 is connected with the moving member 213, even when the closing direction leading end portion 210*a* of the shutter 210 is in the opening operation end position, the knob 208 and the front grid supporting portion 207 are covered with the shutter 210. Accordingly, in this state, the shutter 210 constitutes an obstacle to the demounting and mounting operation of the grid electrode 206.

Here, in this embodiment, the connecting portion 212 can be demounted from the moving member 213. That is, as shown in FIGS. 10 and 11, by eliminating engagement between the engaging projection 231 of the moving member 213 and the engaging hole 232 of the connecting portion 212, the connecting portion 212 can be separated from the holding portion 213*a* of the moving member 213. Specifically, in this embodiment, by flexing the end portions 212*a* and 212*a* of the connecting portion 212 in a direction in which the end portions 212*a* and 212*a* are spaced from each other, the engagement of the engaging projection 231 with the engaging hole 232 is eliminated. In that state, the connecting portion 212 is slid and moved toward the photosensitive member 1 relative to the moving member 213, so that it is possible to separate the connecting portion 212 from the moving member 213.

Further, when the connecting portion 212 is separated from the moving member 213, as shown in FIGS. 9 and 11, the shutter 210 is further wound up by the winding-up mechanism 211 urged in the winding-up direction, so that the connecting portion 212 is moved toward the winding-up mechanism 211 (in a downstream side of the knob 208 with respect to the closing direction). In this embodiment, when the connecting portion 212 reaches the pulling-out portion 214*a* of the holding case 214 for holding the winding-up mechanism 211, the connecting portion 212 prevents further winding-up of the shutter 210. In this state, as shown in FIG. 9, the connecting portion 212 is retracted from the region of the distance L1 between the supporting mechanisms toward the outside of the corona charger 2 by a distance L2 with respect to the longitudinal direction of the corona charger 2. For that reason, in this state, as shown in FIGS. 9 and 11, the knob 208 and the grid supporting portion 207 are not covered with the shutter 210 but are exposed. Accordingly, by operating the knob 208, it becomes possible to demount and mount the grid electrode 206.

Thus, in the charging device 200 in this embodiment, the corona charger 2, disposed opposed to the photosensitive member 1, for electrically charging the photosensitive member 1 is provided. The corona charger 2 includes the grid electrode 206 disposed at the opening 2*a* thereof and the supporting means 224 and 229 for detachably mountably supporting the end portions of the grid electrode 206 with respect to the longitudinal direction of the corona charger 2. Further, the charging device 200 includes the sheet-shaped shutter 210, disposed closer to the photosensitive member 1 than the corona charger 2, for opening and closing the opening 2*a* of the corona charger 2. Further, the charging device 200 includes the moving means 240 as the moving portion for moving the shutter 210 in the opening direction for opening the opening 2*a* and in the closing direction for closing the opening 2*a* along the longitudinal direction of the corona charger 2. Further, the charging device 200 includes the winding-up means 211 rotatable while winding up the shutter 210 in the opening direction. In the charging device 200, when the shutter 210 is in the opening operation end position where the movement of the shutter 210 in the opening direction by the moving means 240 is ended, at least a part of the supporting means 224 in the opening operation end position side is covered with the shutter 210. Further, the charging device 200 has a constitution in which the connecting portion 212 which is provided in the closing direction end side of the shutter 210 and which is separably connected with the moving means 240 to be pulled by the moving means 240 is provided. Further, the longitudinal direction 200 has a constitution in which the holding case 214 as the holding means as described below is provided. That is, the holding means 214 holds, when the connecting portion 212 is separated from the moving means 240, the connecting portion 212 together with the shutter 210 in a state in which the shutter 210 is wound up in the opening direction by the winding-up means in a side outside the supporting means 224 toward the opening operation end position with respect to the longitudinal direction of the corona charger 2. The opening of the pulling-out portion 214*a* is an opening directed toward the photosensitive member 1 as shown in FIG. 11. However, a state thereof is not limited to the case where the opening is disposed in parallel to the surface of the charger toward the photosensitive member as shown in FIG. 11, but the opening may also be provided in an inclined state toward a downstream side of the shutter closing direction.

As described above, according to the present invention, the winding-up means 211 of the shutter 210 can separate the connecting portion 212 from the moving member 213 while being mounted on the corona charger 2 and then can retract the shutter 210 to a position where the shutter 210 does not cover the grid electrode 206. As a result, according to this embodiment, during the demounting and the mounting of the grid electrode 206, there is no need to perform the operation in a state in which the shutter 210 is raised in advance. Further, according to this embodiment, there is no need to increase the movement region, of the shutter 210 by the moving member 213, to a position where the knob 208 is exposed. For that reason, the demounting and mounting operation of the grid electrode 206 becomes easy. Therefore, according to this embodiment, it is possible to improve a demounting operation property of the grid electrode of the corona charger without causing an increase in size of the charging device and a decrease in degree of freedom of disposition of parts.

(Embodiment 2)

Next, another embodiment of the present invention will be described. Basic constitutions and operations of a charging device and an image forming apparatus in this embodiment are the same as those in Embodiment 1. Accordingly, elements having the same or corresponding functions and constitutions as those in Embodiment 1 are represented by the same reference numerals or symbols and will be omitted from detailed description.

FIG. 12 is a schematic sectional view of a charging device 200 with respect to a rotational axis direction of a photosensitive member 1 during a demounting and mounting operation of a grid electrode 206 in this embodiment. Further, FIG. 13 is a perspective view of a front block 201 and the neighborhood thereof of the charging device 200 as seen from the photosensitive member 1 side during the demounting and mounting operation of the grid electrode 206 in this embodiment.

In this embodiment, after the connecting portion 212 is separated from the moving member 213 constituting the moving portion in order to perform the demounting and mounting operation of the grid electrode 206, the holding case 214 in a state in which the holding case 214 holds the connecting portion 212 can be rotated in an arrow R4 direction in the figures. As a result, the shutter 210 can be largely retracted from the knob 208 as the operating portion and the front grid supporting portion 207 as the first supporting portion. That is, in this embodiment, with respect to the longitudinal direction of the corona charger 2, the distance L3 in which the connecting portion 212 can be retracted to an outside of the region of the distance L1 between the supporting mechanisms is larger than the distance L3 in Embodiment 1.

In this embodiment, the contact 214 is supported by the front block 201 rotatably about an axis, as a rotation center, substantially perpendicular to the longitudinal direction of the corona charger 2. Particularly, in this embodiment, in order to widely open the knob 208 and the front grid supporting portion 207 which are provided on the front block 201, the holding case 214 is configured so as to be rotatable, in the arrow R4 direction in FIGS. 12 and 13 and in an opposite direction to the arrow R4 direction by about 90 degrees, between the corona charger 2 and the photosensitive member 1.

Further, by the rotation of the holding case 214 to an open state (FIG. 13), the pulling out portion 214*a*, the guide roller 215 and the cover portion 214*b* of the holding case 214 are rotated as a unit. By the rotation of the holding case 214 by about 90 degrees, the cover portion 214*b* is raised toward the photosensitive member 1 with respect to a direction substantially perpendicular to a flat surface formed by the opening 2*a*. For that reason, by placing the holding case 214 in the open state (FIG. 13), the shutter 210 and the connecting portion 212 can be largely retracted from the edge of the grid electrode 206, the front grid supporting portion 207, the knob 208, and the like. At the same time, the retracted shutter 210 and connecting portion 212 and a space in which a demounting operation of the grid electrode 206 in the neighborhood of the knob 208 is to be performed can be covered with the cover portion 214*b*. In this way, the cover portion 214*b* of the holding case 214 functions as a shielding portion. Therefore, during the demounting and mounting operation of the grid electrode 206, a possibility of erroneous touch on the connecting portion 212 constituted by a thin plate is lowered, so that it is possible to lower a possibility that the shutter 210 and the connecting portion 212 are broken. Further, at the same time, an operating space of the knob 208 for demounting and mounting the grid electrode 206 can be mode wide, and therefore the demounting and mounting operation of the grid electrode 206 is further simplified.

Further, in this embodiment, a rotation shaft (axis) of the hold 214 is substantially coaxially with the rotation shaft 221 of the winding-up means 211. As a result, sizes of the holding case 214 and the front block 201 for supporting the holding case 214 can be decreased. Accordingly, an occupied space of the corona charger 2 can be reduced. Specifically, in this embodiment, as shown in FIG. 14, a length L5 of the rotation shaft 221 of the winding-up means 211 with respect to the axial direction is made longer than a length L6 between side walls 214*c* and 214*c* of the holding case 214 with respect to the axial direction. Further, the rotation shaft 221 is inserted into through holes 214*d* and 214*d* formed in the side walls 214*c* and 214*c* of the holding case 214 and bearing holes 201*b* and 201*b* provided in the front block 201. As a result, the winding-up mechanism 211 and the holding case 214 are rotatably supported by the front block 201.

Here, as described above, in a state in which the shutter 210 is pulled out, a position of the shutter 210, in the winding-up mechanism 211 side, with respect to the substantially radial direction of the photosensitive member 1 is determined by the guide roller 215 supported by the holding case 214. When there is play with respect to supporting of the holding case 214 and therefore the shutter 210 sags in the closed state (FIG. 11) of the holding case 214 with respect to the substantially radial direction of the member 1, a clearance between the shutter 210 and the photosensitive member 1 becomes small. For that reason, the holding case 214 may desirably be supported in a state in which the holding case 214 is urged in the direction toward the front block 201 by using a helical coil spring as the urging means. As a result, the play of the holding case 214 with respect to the substantially radial direction of the member 1 is eliminated, so that a possibility that the shutter 210 slides on the member 1 can be lowered. Incidentally, in this embodiment, in a state in which the connecting portion 212 is separated from the moving member 213 and then reaches the pulling-out portion 214*a* of the holding case 214, the hold 214 is maintained in the open state (FIG. 13) by an urging force in a direction in which the winding-up mechanism 211 as the winding-up portion winds up the shutter 210.

Thus, in this embodiment, the holding case 214 as the holding means disposes the connecting portion 212 further outside the supporting means 224 in the opening operation end position side by being rotated from the state in which the holding case 214 holds the connecting portion 212 in the outside of the supporting means 224 in the opening operation end position side. Further, the holding case 214 as the holding means includes the cover portion 214*b* as a shielding portion raising between the supporting means 224 in the opening operation end position side and members such as the shutter 210 and the connecting portion 212 by being rotated.

As described above, according to this embodiment, an effect similar to that in Embodiment 1 can be obtained, and at the same time, a possibility of breaking of the shutter 210 and the connecting portion 212 during the demounting and mounting operation of the grid electrode 206 can be reduced. Further, operativity of the demounting and mounting operation can be improved.

(Embodiment 3)

Next, another embodiment of the present invention will be described. Basic constitutions and operations of a charging device and an image forming apparatus in this embodiment are the same as those in Embodiments 1 and 2. Accordingly, elements having the same or corresponding functions and constitutions as those in Embodiments 1 and 2 are represented by the same reference numerals or symbols and will be omitted from detailed description.

Part (a) of FIG. 15 is a schematic sectional view of a charging device 200 with respect to a rotational axis direction of the photosensitive member 1 in a state in which a shutter 210 is open in this embodiment. Part (b) of FIG. 15 is a schematic sectional view of the charging device 100 with respect to the rotational axis direction of the photosensitive member 1 in a state in which the shutter 210 is closed in this embodiment.

Further, FIG. 16 is a schematic sectional view of a charging device 200 with respect to a rotational axis direction of a photosensitive member 1 during a demounting and mounting operation of a grid electrode 206 in this embodiment. Further, FIG. 17 is a perspective view of a front block 201 and the neighborhood thereof of the charging device 200 as seen from the photosensitive member 1 side when the shutter 210 is in the opening operation end position (home position). Further, FIG. 18 is a perspective view, similar to FIG. 17, during an operation of the shutter 210. Further, FIG. 19 is a perspective views, similar to FIG. 17, in a state in which the holding case 214 is rotated during the demounting and mounting operation of the grid electrode 206.

In this embodiment, similarly as in Embodiment 2, the holding case 214 is rotatable. However, in this embodiment, the connecting portion 212 is held in the holding case 214 in a state in which the shutter 210 is in the opening operation end position in order to perform the demounting and mounting operation of the grid electrode 206. Further, by rotating the holding case 214 placed in the state in which the holding case 214 holds the connecting portion, the connecting portion 212 is separated from the moving member 213, so that the connecting portion 212 is retracted from the knob 208, the front grid supporting portion 207, and the like.

Specifically, as shown in FIGS. 17 to 19, end portions 212*a* and 212*a* as projected portions of the connecting portion 212 are provided with first engaging grooves 233 and 233 as cut-away portions (grooves) extending from edges 212*d* and 212*d*, opposite from a fixing portion 212*b*, toward the fixing portion 212*b*. The first engaging grooves 233 and 233 are first engaging portions provided on the connecting portion 212. In a state in which the shutter 210 is in the opening operation end position, the first engaging grooves 233 and 233 extend in a substantially rectilinear line shape in a substantially radial direction of the photosensitive member 1.

Further, the connecting portions 212*a* and 212*a* provided with second engaging grooves 234 and 234 as cut-away portions (grooves). The second engaging grooves 234 and 234 extend from side edges 212*e* and 212*e*, of side edges extending from the edges 212*d* and 212*d* toward the fixing portion 212*b*, toward other (opposite) side edges. The second engaging grooves 234 and 234 are second engaging portions provided on the connecting portion 212. In a state in which the shutter 210 is in the opening operation end position, the second engaging grooves 234 and 234 extends in a substantially rectilinear line shape in the longitudinal direction of the corona charger 2.

Further, holding portions 213*a* and 213*a* of the moving member 213 are provided, at portions disposed closer to the member 1 than the shields 203 and 204, with first engaging projections (first supporting portions) 222 and 222 projected toward the outside of the opening 2*a* along the widthwise direction of the opening 2*a*. The first engaging projections 222 and 222 are first engaging portions provided on the moving member 213. The first engaging projections 222 and 222 extend in the substantially rectilinear line shape in the substantially radial direction of the member 1.

Further, cover portions 214*a* and 214*a* of the holding cases 214 are provided, at portions disposed closer to the member 1 than the shields 203 and 204, with second engaging projections (second supporting portions) 223 and 223 projected toward the outside of the opening 2*a* along the widthwise direction of the opening 2*a*. The second engaging projections 223 and 223 are provided adjacently to rear end portions of the cover portions 214*b* and 214*b* of the holding case 214. The second engaging projections 223 and 223 are second engaging portions provided on the holding case 214. The second engaging projections 223 and 223 extend, in a state in which the shutter 210 is in the opening operation end position, in the substantially rectilinear line shape in the longitudinal direction of the corona charger 2.

The first engaging projections 222 and 222 are engaged with (loosely engaged into) the first engaging grooves 233 and 233 slidably along the axial direction thereof in a state in which the axes thereof are disposed in substantially parallel to the axes of the first engaging grooves 233 and 233. Further, the second engaging projections 223 and 223 are engaged with (loosely engaged into) the second engaging grooves 234 and 234 slidably along the axial direction thereof in a state in which the axes thereof are disposed in substantially parallel to the axes of the second engaging grooves 234 and 234.

Further, when the shutter 210 is in the opening operation end position, as shown in (a) of FIG. 15 and FIG. 17, the first engaging grooves 233 and 233 of the connecting portion 212 are engaged with the first engaging projections 222 and 222 of the moving member 213. Further, at the same time, the second engaging grooves 234 and 234 of the connecting portion 212 are engaged with the second engaging projections 223 and 223 of the holding case 214. In this way, in the opening operation end position, the connecting portion 212 is engaged with both of the moving member 213 and the holding case 214.

Then, the shutter 210 moves from the opening operation end position in the closing direction (arrow A2 direction in FIG. 17). Then, as shown in (b) of FIG. 15 and FIG. 18, the second engaging grooves 234 and 234 of the connecting portion 212 are moved in the closing direction (arrow A2 direction in FIG. 18) along the longitudinal direction of the corona charger 2 and then are disengaged from the second engaging projections 223 and 223 of the holding case 214. Then, the connecting portion 212 is moved in a state in which the first engaging grooves 233 and 233 are engaged with the first engaging projections 222 and 222 of the moving member 213, thus moving the shutter 210.

Incidentally, in this embodiment, side surfaces of the holding portions 213*a* and 213*a* of the moving member 213 are sandwiched between the side portions 212*a* and 212*a* of the connecting portion 212. Further, the shutter 210 is urged in the winding-up direction by the winding-up mechanism 211, so that the side portions of the first engaging grooves 233 and 233 are urged toward the side portions of the first engaging projections 222 and 222. As a result, even in a state in which the shutter 210 is moved from the opening operation end position, the connecting portion 212 is prevented from being disengaged from the moving member 213.

Next, when the shutter 210 is returned to the opening operation end position, as shown in FIG. 17, the second engaging grooves 234 and 234 of the connecting portion 212 are engaged with the second engaging projections 223 and 223 of the holding case 214 by being moved in the opening direction (arrow A1 direction in FIG. 17) along the longitudinal direction of the corona charger 2. As a result, the connecting portion 212 is placed again in the state in which the connecting portion 212 is engaged with both of the moving member 213 and the holding case 214.

Then, during the demounting and mounting operation of the grid electrode 206, the holding case 214 is rotated in the arrow R4 direction in FIG. 19 from the closed state (FIG. 17) to the open state (FIG. 19). Then, as shown in FIGS. 16 and 19, the first engaging grooves 233 and 233 of the connecting portion 212 are moved in the arrow A2 direction in FIG. 19 and then are disengaged from the first engaging projections 222 and 222 of the moving member 213. Then, the second engaging grooves 234 and 234 of the connecting portion 212 are rotated in an engaged state with the second engaging projections 223 and 223 of the holding case 214.

Incidentally, in this embodiment, side surfaces of the cover portions 214*a* and 214*a* of the holding case 214 are sandwiched between the side portions 212*a* and 212*a* of the connecting portion 212. Further, the shutter 210 is urged in the winding-up direction by the winding-up mechanism 211, so that the end portions of the second engaging grooves 234 and 234 are urged toward the end portions of the second engaging projections 223 and 223. As a result, even in a state in which the holding case 214 is rotated, the connecting portion 212 is prevented from being disengaged from the holding case 214.

Further, in this embodiment, the first engaging projections 222 and 222 and the first engaging grooves 233 and 233 have the substantially rectilinear line shape. With respect to the movement direction of the first engaging grooves 233 and 233, a movement locus is exactly an arcuate shape along the arrow R4 direction in FIG. 19, but an engagement distance between each engaging groove and an associated engaging projection in this embodiment is relatively small and there is play between these engaging groove and projection. Accordingly, the movement direction of the first engaging grooves 233 and 233 relative to the first engaging projections is regarded as the substantially rectilinear line shape, so that shapes of these engaging grooves and projections are regarded as the substantially rectilinear line shape. However, as desired, the shapes of these engaging grooves and projections may also be the arcuate shape.

In this embodiment, with respect to the longitudinal direction of the corona charger 2, the distance L3 in which the connecting portion 212 can be retracted to the outside of the region of the distance L1 between the supporting mechanisms is the same as the distance L3 in the case of Embodiment 2.

Next, when the demounting and mounting operation of the grid electrode 206 is ended or the like, the holding case 214 is returned to the closed state (FIG. 17). In this case, the first engaging grooves 233 and 233 of the connecting portion 212 are moved in an opposite direction to the arrow R4 direction in FIG. 19, and are engaged with the first engaging projections 222 and 222 of the moving member 213 as shown in FIG. 17. As a result, the connecting portion 212 is placed again in the state in which the connecting portion 212 is engaged with both of the moving member 213 and the holding case 214.

In this way, in this embodiment, the holding case 214 as the holding means is engaged with the connecting portion 212 when the shutter 210 is in the opening operation end position. Further, the holding case 214 is rotated from that state to be placed in a state in which the holding case 214 holds the connecting portion 212 outside the supporting means 224 in the opening operation end position side with respect to the longitudinal direction of the corona charger 2. Particularly, in this embodiment, the moving means 240 includes the first engaging portion 222 to be engaged with the connecting portion 212 when the shutter 210 is moved and to be disengaged from the connecting portion 212 by rotating the holding means 214 together with the connecting portion 212. Further, the holding means 214 includes the second engaging portion 223 to be engaged with the connecting portion 212 by moving the shutter 210 to the opening operation end position by the moving means 240.

As described above, in this embodiment, in the case where the shutter 210 is operated to be opened and closed, the connecting portion 212 is supported by the moving member 213. Further, in the case where the holding case 214 is rotated in order to perform the demounting and mounting operation of the grid electrode 206, the connecting portion 212 is supported by the mechanism 214. Further, when one of the opening and closing operation of the shutter 210 and the rotation operation of the holding case 214 is performed supporting when the other operation is performed is eliminated. For that reason, without performing the separating operation between the connecting portion 212 and the moving member 213 as in Embodiments 1 and 2, the demounting and mounting operation of the grid electrode 206 can be performed only by rotating the holding case 214 when the shutter 210 is in the opening operation end position. As a result, in this embodiment, effects similar to those in Embodiments 1 and 2 can be obtained, and it becomes possible to demounted and mount the grid electrode 206 more simply.

(Embodiment 4)

Next, another embodiment of the present invention will be described. Basic constitutions and operations of a charging device and an image forming apparatus in this embodiment are the same as those in Embodiment 1. Accordingly, elements having the same or corresponding functions and constitutions as those in Embodiment 1 are represented by the same reference numerals or symbols and will be omitted from detailed description.

FIG. 20 is a schematic view of a charging device 200, in a state in which a shutter is separated form a moving portion, as seen in a longitudinal direction of the charging device 200 in this embodiment. FIG. 21 is a schematic view of the charging device 200, in a state in which the shutter is connected with the moving portion, as seen in the longitudinal direction of the charging device 200 in this embodiment.

In this embodiment, a connecting mechanism between a connecting portion provided at a closing direction leading end portion of a shutter 210 and a holding portion 213*a* of a moving member 213 is different from the connecting mechanism in Embodiment 1, and other portions are similar to those in Embodiment 1.

Specifically, in this embodiment, as shown in FIGS. 20 and 21, side end portions 212*h* and 212*h* as the projected portions are configured to be insertable into an opening 213*o* provided in the holding portion 213*a*. When the side end portions 212*h* and 212*h* are inserted into the opening 213*o* provided in the holding portion 213*a*, projections 212*f* provided on the side end portions 212*h* and 212*h* are engaged with recesses 213*e* provided at the opening 213*o* of the holding portion 213*a*, so that the connecting portion 212 is connected with and fixed to the moving portion (member) 213.

When the connecting portion 212 is separated from the moving portion 213, releasing portions 212*g* provided on the side end portions 212*h* and 212*h* are urged in an arrow B direction, whereby the projections 212*f* of the side end portions 212*h* and 212*h* are disengaged from the recesses 213*e* provided in the holding portion 213*a*, and thus it becomes possible to pull out the side end portions 212*h* and 212*h* through the opening 213*o* provided in the holding portion 213*a*.

By employing such a mechanism, the demounting operation of the shutter 210 from the moving portion 213 becomes easy, so that a similar effect to the effect in Embodiment 1 can be obtained, and it becomes possible to demount and mount the grid electrode 206 more simply.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications No. 251574/2012 filed Nov. 15, 2012 and 229757/2013 filed Nov. 5, 2013, which are hereby incorporated by reference.

What is claimed is:

1. A charging device for electrically charging a photosensitive member, comprising:

a discharging electrode provided along a longitudinal direction of said charging device;

a casing which surrounds said discharging electrode and which is provided with an opening between said discharging electrode and the photosensitive member;

a grid provided at the opening along the longitudinal direction of said charging device;

a sheet-shaped shutter, provided closer to the photosensitive member than said grid, for opening and closing the opening;

a moving portion for moving said shutter, along the longitudinal direction of said charging device, in an opening direction for opening the opening and a closing direction for closing the opening;

a connecting portion, provided at a leading end portion of said shutter with respect to the closing direction, for being separably connected with said moving portion;

a winding-up portion for winding-up said shutter with movement of said shutter in the opening direction;

an urging portion for urging said shutter in a winding-up direction of said shutter;

a first supporting portion for detachably mountably supporting an upstream end portion, with respect to the closing direction, of end portions of said grid with respect to a longitudinal direction of said grid;

a second supporting portion for detachably mountably supporting a downstream end portion, with respect to the closing direction, of the end portions of said grid with respect to the longitudinal direction of said grid; and an operating portion, provided downstream of said first supporting portion with respect to the opening direction, operable so that the first supporting portion is moved to a position where the first supporting portion and said grid are detachably mountable, wherein said winding-up portion is configured to wind up, when said shutter is open, said shutter so that a surface of said shutter opposing the photosensitive member is an outermost surface, wherein when movement of said shutter in the opening direction is completed, said operating portion is covered with said shutter, and wherein when said connecting portion is separated from said moving portion, the leading end portion of said shutter with respect to the closing direction is movable toward a downstream side of said operating portion with respect to the opening direction by a winding-up force by said urging portion.

2. A device according to claim 1, wherein said winding-up portion is provided at an opening direction-side end portion of said charging device with respect to the longitudinal direction of said charging device, wherein said charging device further comprises a holding case for holding said winding-up portion while surrounding said winding-up portion, and the holding case is provided with a pulling-out portion which is an opening for permitting pulling-out of said shutter, and wherein when said connecting portion is separated from said moving portion, said connecting portion is movable to the pulling-out portion.

3. A device according to claim 2, wherein the pulling-out portion is open, in said charging device, toward the photosensitive member.

4. A device according to claim 1, wherein said connecting portion includes a fixed portion fixed at the leading end portion of said shutter with respect to the closing direction and a projected portion projected from each of end portions of the fixed portion toward said grid with respect to a widthwise direction of said shutter, and wherein said connecting portion is separably connected with said moving portion by the projected portion.

5. A device according to claim 4, wherein the fixing portion limits a shape of the leading end portion of said shutter with respect to the closing direction so that the end portion projects toward said grid at a central portion more than at widthwise end portions of said shutter.

6. A device according to claim 4, wherein the projected portion includes a projection, and the projection is engaged with a recess provided in said moving portion to connect said connecting portion with said moving portion.

7. A device according to claim 1, wherein said operating portion and said first supporting portion are provided on a same member.

8. A device according to claim 1, wherein said first supporting portion is urged toward the opening direction.

* * * * *